US007941068B2

(12) United States Patent
Kimura

(10) Patent No.: US 7,941,068 B2
(45) Date of Patent: May 10, 2011

(54) IMAGE FORMING APPARATUS, IMAGE FORMING SYSTEM, AND RECORDING MEDIUM

(75) Inventor: Shuuichi Kimura, Tokyo (JP)

(73) Assignee: Ricoh Company Limited, Tokyo (JP)

( * ) Notice: Subject to any disclaimer, the term of this patent is extended or adjusted under 35 U.S.C. 154(b) by 474 days.

(21) Appl. No.: 12/105,740

(22) Filed: Apr. 18, 2008

(65) Prior Publication Data

US 2008/0260413 A1 Oct. 23, 2008

(30) Foreign Application Priority Data

Apr. 20, 2007 (JP) ..... 2007-112169

(51) Int. Cl.
*G03G 15/00* (2006.01)

(52) U.S. Cl. ..... 399/82; 399/405

(58) Field of Classification Search ..... 399/82, 399/403, 405, 407
See application file for complete search history.

(56) References Cited

U.S. PATENT DOCUMENTS

| | | | |
|---|---|---|---|
| 4,181,429 | A | 1/1980 | Batchelor et al. |
| 4,627,706 | A | 12/1986 | Takahashi et al. |
| 6,168,145 | B1 | 1/2001 | Tanaka et al. |
| 2008/0003011 | A1 * | 1/2008 | Unno ..... 399/82 |

FOREIGN PATENT DOCUMENTS

| | | | |
|---|---|---|---|
| JP | 2003-87560 | * | 3/2003 |
| JP | 2005-94524 | * | 4/2005 |
| JP | 2005-234328 | * | 9/2005 |
| JP | 2006-3568 | * | 1/2006 |

* cited by examiner

*Primary Examiner* — David M Gray
*Assistant Examiner* — Rodney Bonnette
(74) *Attorney, Agent, or Firm* — Oblon, Spivak, McClelland, Maier & Neustadt, L.L.P.

(57) ABSTRACT

An image forming apparatus includes a discharge tray determination device and a print controller. The discharge tray determination device determines a discharge tray for sample print output from available discharge trays specifiable by the image forming apparatus. The print controller divides a print job into print processes and controls print output in response to a sample print output request to cause a print process for sample print output for specifying the discharge tray determined by the discharge tray determination device to interrupt the print job.

19 Claims, 15 Drawing Sheets

FIG. 10

380

380A 380B

| PRIORITY ORDER | DISCHARGE TRAY |
|---|---|
| 1 | UPPER TRAY |
| 2 | BODY TRAY |
| 3 | FIRST STACKER TRAY |
| 4 | SECOND STACKER TRAY |
| 5 | LOWER FINISHER TRAY |
| 6 | UPPER FINISHER TRAY |

FIG. 11

300

| TRAY/TYPE | PLAIN PAPER (304) | OHP (306) | THICK PAPER (308) | GLOSS PAPER (310) | . . . |
|---|---|---|---|---|---|
| BODY TRAY (312) | AVAILABLE | AVAILABLE | AVAILABLE | AVAILABLE | . . . |
| UPPER TRAY (314) | AVAILABLE | UNAVAILABLE | UNAVAILABLE | AVAILABLE | . . . |
| UPPER FINISHER TRAY (316) | AVAILABLE | AVAILABLE | AVAILABLE | AVAILABLE | . . . |
| LOWER FINISHER TRAY (318) | AVAILABLE | UNAVAILABLE | UNAVAILABLE | AVAILABLE | . . . |
| FIRST STACKER TRAY (320) | AVAILABLE | AVAILABLE | UNAVAILABLE | AVAILABLE | . . . |
| SECOND STACKER TRAY (322) | AVAILABLE | AVAILABLE | UNAVAILABLE | UNAVAILABLE (324) | . . . |

FIG. 12

350

| TRAY/TYPE | A3 (354) | B4 (356) | A4 (358) | B5 (360) | . . . |
|---|---|---|---|---|---|
| BODY TRAY (362) | AVAILABLE | AVAILABLE | AVAILABLE | AVAILABLE | . . . |
| UPPER TRAY (364) | UNAVAILABLE | AVAILABLE | AVAILABLE | AVAILABLE | . . . |
| UPPER FINISHER TRAY (366) | AVAILABLE | AVAILABLE | AVAILABLE | AVAILABLE | . . . |
| LOWER FINISHER TRAY (368) | UNAVAILABLE | UNAVAILABLE | AVAILABLE | AVAILABLE | . . . |
| FIRST STACKER TRAY (370) | UNAVAILABLE | UNAVAILABLE | AVAILABLE | AVAILABLE | . . . |
| SECOND STACKER TRAY (372) | UNAVAILABLE | UNAVAILABLE | UNAVAILABLE | AVAILABLE (374) | . . . |

IMAGE FORMING APPARATUS, IMAGE FORMING SYSTEM, AND RECORDING MEDIUM

CROSS-REFERENCE TO RELATED APPLICATION

The present application is based on and claims priority from Japanese Patent Application No. 2007-112169, filed on Apr. 20, 2007 in the Japan Patent Office, the entire contents of which are hereby incorporated herein by reference.

BACKGROUND OF THE INVENTION

1. Field of the Invention

Exemplary aspects of the present invention relate to an image forming apparatus, an image forming system, and a recording medium, and more particularly, to an image forming apparatus, an image forming system, and a recording medium for properly performing sample print output.

2. Description of the Related Art

A related-art image forming apparatus, such as a copier, a facsimile machine, a printer, or a multifunction printer having two or more of copying, printing, scanning, and facsimile functions, forms a toner image on a transfer material (e.g., a transfer sheet) according to image data by electrophotography. For example, a charger charges a surface of a photoconductor. An optical writer emits a light beam onto the charged surface of the photoconductor to form an electrostatic latent image on the photoconductor according to the image data. A development device develops the electrostatic latent image with a developer (e.g., toner) to form a toner image on the photoconductor. The toner image is then transferred from the photoconductor onto a transfer sheet. A fixing device applies heat and pressure to the transfer sheet bearing the toner image to fix the toner image on the sheet.

With recent advances such image forming apparatuses (e.g., digital copiers and laser printers) have gained improved speed and endurance, making mass-printing possible. However, an increase in frequency of printing may cause faster deterioration of such parts of the image forming apparatus as a photoconductor, a feed roller, a conveyance roller and the like, resulting in deterioration in print image quality over time. Therefore, in order to provide stable high-quality printing, such image quality needs to be checked regularly with a predetermined frequency. Conventionally, this regular checking is accomplished by the image forming apparatus interrupting a current print job so that a user may visually check the image quality of a printed sheet.

One related-art image forming apparatus includes a surface imaging device for taking an image of the printed sheet and a display device for displaying the image taken by the surface imaging device, so that a user may visually check a state of an image formed on the printed sheet and a state of a stored transfer sheet. However, the surface imaging device is typically a CCD (charge coupled device) camera and the display device a liquid crystal display, resulting in high cost. Moreover, although the user can confirm the image taken by the surface imaging device of the image forming apparatus, the user cannot confirm an actual image printed on the sheet.

Another known related-art image forming apparatus has a sample print function for printing a set of printed sheets as a sample print. When the related-art image forming apparatus performs a sample print before starting a print job, a user visually checks an actual image printed on the sheet as a sample and then determines whether or not to start the print job. However, in order to do so the user needs to interrupt a printing operation in order to check the actual image printed on the sheet, resulting in decreased productivity especially in mass-printing. In addition, the user does not need a whole set of printed sheets, but merely needs one arbitrary sheet to check the quality of the image printed on the sheet.

Obviously, such decreased productivity due to interruption of a printing operation is undesirable, and accordingly, there is a need for a technology to efficiently check the quality of an image printed on a sheet.

BRIEF SUMMARY OF THE INVENTION

This specification describes an image forming apparatus according to exemplary embodiments of the present invention. In one exemplary embodiment of the present invention, the image forming apparatus includes a discharge tray determination device and a print controller. The discharge tray determination device is configured to determine a discharge tray for sample print output from available discharge trays specifiable by the image forming apparatus. The print controller is configured to divide a print job into print processes and control print output in response to a sample print output request to cause a print process for sample print output for specifying the discharge tray determined by the discharge tray determination device to interrupt the print job.

This specification further describes an image forming system according to exemplary embodiments of the present invention. In one exemplary embodiment of the present invention, the image forming system includes an image forming apparatus and a post-processing device. The image forming apparatus is configured to print a sample image on a transfer member. The post-processing device is configured to receive the transfer member bearing the sample image sent from the image forming apparatus. The post-processing device includes a discharge tray for receiving the transfer member bearing the sample image. The image forming apparatus includes a discharge tray determination device and a print controller as described above.

This specification further describes a machine-readable recording medium according to exemplary embodiments of the present invention. In one exemplary embodiment of the present invention, the machine-readable recording medium is configured to store a machine-executable program for operating an image forming apparatus for performing sample print output. The image forming apparatus includes a discharge tray determination device and a print controller as described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein:

FIG. 10 is a lookup table showing a data structure of discharge tray priority information set by the GUI shown in FIG. 9;

FIG. 11 is a lookup table showing a data structure of available sheet type information included in the element shown in FIG. 6;

FIG. 12 is a lookup table showing a data structure of available sheet size information included in the element shown in FIG. 6;

DETAILED DESCRIPTION OF THE INVENTION

Figure 1:
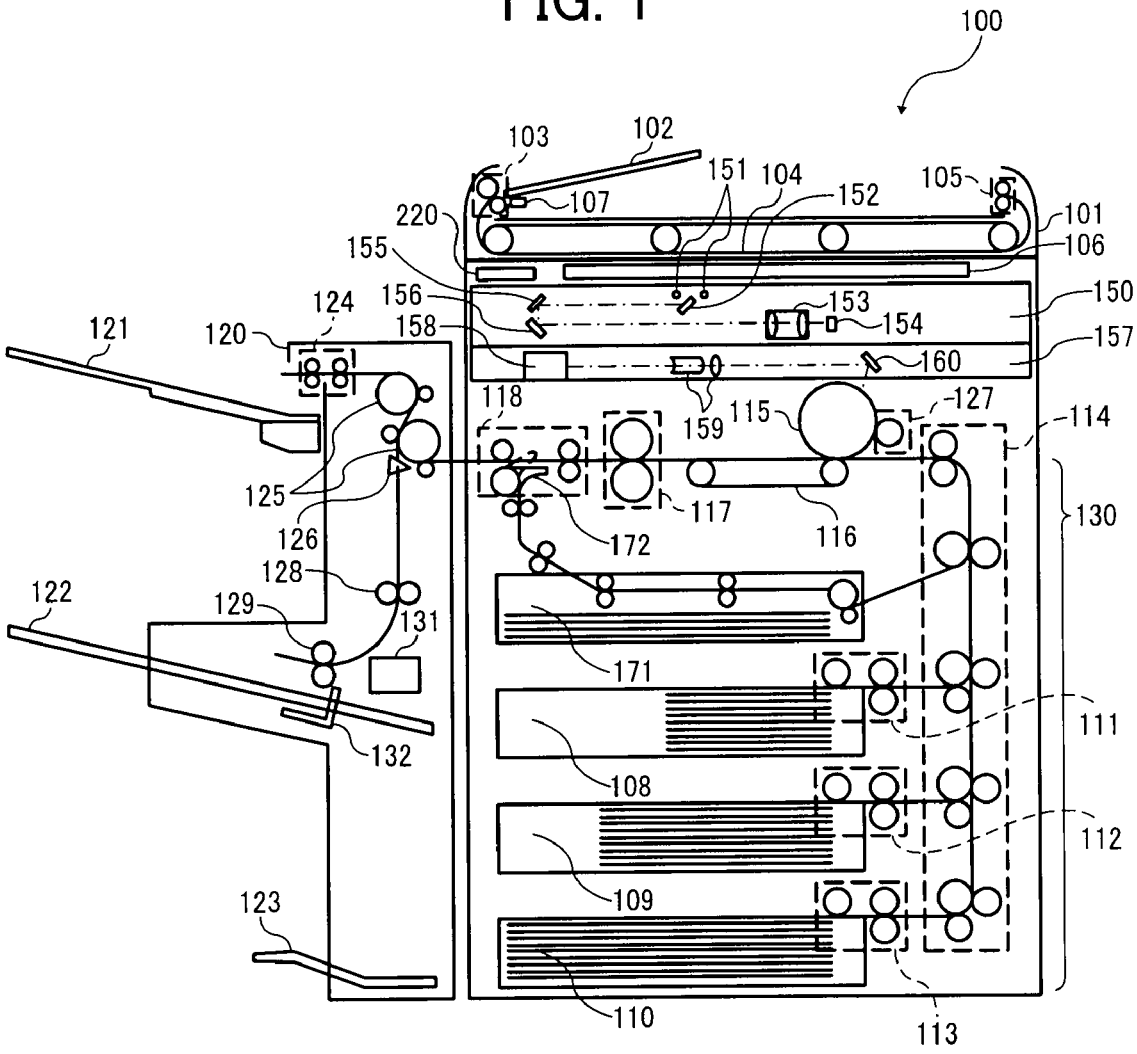
FIG. 1 is a schematic view of a multifunction printer according to an exemplary embodiment of the present invention.

In describing exemplary embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, in particular to FIG. 1, a multifunction printer 100 and a post-processing device 120 according to an exemplary embodiment of the present invention is described, together with their operation.

FIG. 1 is a schematic view of the multifunction printer 100. According to this non-limiting exemplary embodiment, the multifunction printer 100, serving as an image forming apparatus, has two or more of copying, printing, scanning, and facsimile functions, or the like.

The multifunction printer 100 includes an ADF (auto document feeder) 101, an exposure glass 106, an image reading unit 150, an image forming unit 157, a development unit 127, a transfer-fixing unit 130, a duplex unit 171, a discharge unit 118, and a control panel 220. The ADF 101 includes an original tray 102, a feed roller 103, a feed belt 104, a discharge roller 105, and a sensor 107. The image reading unit 150 includes exposure lamps 151, a first mirror 152, a second mirror 155, a third mirror 156, a lens optical system 153, and a CCD (charge coupled device) image sensor 154. The image forming unit 157 includes a laser transmitter 158, an imaging lens optical system 159, a mirror 160, and a photoconductor drum 115. The transfer-fixing unit 130 includes paper trays 108, 109, and 110, feeding units 111, 112, and 113, a conveyance unit 114, a conveyance belt 116, and a fixing unit 117. The discharge unit 118 includes a separation nail 172. The post-processing device 120 includes a discharge tray 121, a staple tray 122, a storage tray 123, normal conveyance rollers 125, normal discharge rollers 124, a switching plate 126, stapler conveyance rollers 128, stapler discharge rollers 129, a jogger 132, and a stapler 131.

In the ADF 101, the feed roller 103, the feed belt 104, and the discharge roller 105 are driven by a motor, not shown. The feed roller 103 and the feed belt 104 convey an uppermost original document from the original tray 102 to a predetermined position on the exposure glass 106, at which an image on the original document is read, and the feed belt 104 and the discharge roller 105 discharge the original document. When the sensor 107 detects another original document remaining on the original tray 102, that other original document is conveyed to the exposure glass 106 and discharged after image reading. In this manner, the ADF 101 feeds and discharges the original documents until reading of images on all original documents is finished.

In the image reading unit 150, when the exposure lamps 151 emit light to the original document on the exposure glass 106, the light reflected from the original document is reflected by the first mirror 152, the second mirror 155, and the third mirror 156, and transmitted to the CCD image sensor 154 through the lens optical system 153 to read the image.

In the image forming unit 157, when the laser transmitter 158 emits a laser beam to the imaging lens optical system 159, the laser beam is reflected by the mirror 160 to irradiate a surface of the photoconductor drum 115, thereby forming an electrostatic latent image thereon.

When the electrostatic latent image is conveyed to the development unit 127 according to rotation of the photoconductor drum 115, the electrostatic latent image is developed with a developer (e.g., a toner) to form an image (e.g., a toner image) on the photoconductor drum 115 for carrying the image. The toner image formed on the photoconductor drum 115 is conveyed to the transfer-fixing unit 130 according to rotation of the photoconductor drum 115. After the respective feeding units 111, 112, and 113 feed a transfer member (e.g., a transfer sheet) stored in the respective paper trays 108, 109, and 110, the conveyance unit 114 conveys the transfer sheet to a position at which the transfer sheet contacts the photoconductor drum 115. The transfer sheet is not limited to paper, but may include a material capable of bearing an image such as a plastic sheet, a paper sheet coated with a resin and the like.

When the transfer sheet is electrostatically attracted to the conveyance belt 116, the toner image formed on the photoconductor drum 115 is transferred by a transfer bias potential to the transfer sheet to form an image thereon. After the fixing unit 117 fixes the image formed on the transfer sheet, the discharge unit 118 discharges the transfer sheet to the post-processing device 120.

In duplex printing, when the separation nail 172 is set in an upper position, the transfer sheet is temporarily stored in the duplex unit 171, so as not to be conveyed to the post-processing device 120. Thereafter, the transfer sheet is again conveyed to the transfer-fixing unit 130, so that an image is transferred and fixed to a back surface of the transfer sheet. After the duplex printing, when the separation nail 172 is set in a lower position, the transfer sheet is conveyed to the post-processing device 120.

The post-processing device 120 is connected to the multifunction printer 100. The normal conveyance rollers 125 and the normal discharge rollers 124 discharge the transfer sheet to the discharge tray 121. The stapler conveyance rollers 128 and the stapler discharge rollers 129 discharge the transfer sheet to the staple tray 122. The switching plate 126 switches a conveyance direction of the transfer sheet between directions to the discharge tray 121 and the staple tray 122. When the switching plate 126 is directed in an upward direction, the transfer sheet is guided toward the normal conveyance rollers 125. When the switching plate 126 is directed in a downward direction, the transfer sheet is guided toward the stapler conveyance rollers 128. Whenever the transfer sheet is discharged to the staple tray 122, the jogger 132 jogs an edge of the transfer sheet based on printing settings, and the stapler 131 staples one set of transfer sheets. One set of transfer sheets stapled by the stapler 131 falls to the storage tray 123 under its own weight. The discharge tray 121 may move back and forth reciprocally, so as to sort each transfer sheet or each set of transfer sheets.

According to this exemplary embodiment, the discharge unit 118 discharges the transfer sheet to the post-processing device 120. Alternatively, however, when the multifunction printer 100 is connected to another device, the discharge unit 118 may discharge the transfer sheet to a discharge member (e.g., a discharge tray) included in the device. In addition, according to this non-limiting exemplary embodiment, the multifunction printer 100 includes the single photoconductor drum 115. Alternatively, however, the multifunction printer 100 may include a plurality of photoconductor drums 115 for black, cyan, magenta, yellow, and the like, and corresponding image forming units 157, so as to perform multiple color printing.

Figure 2:
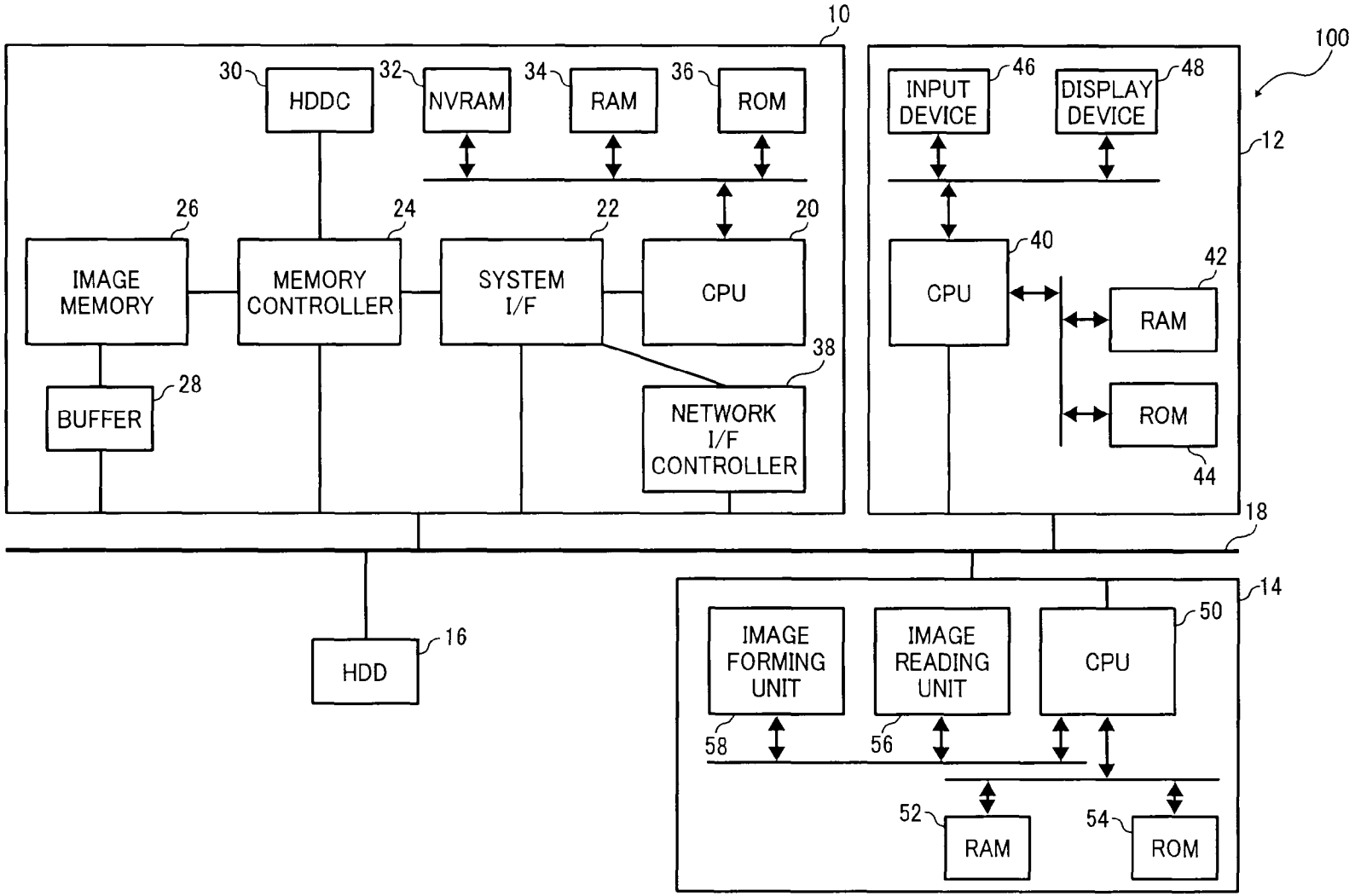
FIG. 2 is a block diagram of a hardware configuration of the multifunction printer shown in FIG. 1.

FIG. 2 illustrates a hardware configuration of the multifunction printer 100 according to the above-described exemplary embodiment.

The multifunction printer 100 further includes a system controller 10, an operation device 12, an image input-output device 14, a HDD (hard disc drive) 16, and an image data bus 18. The system controller 10 includes a CPU (central processing unit) 20, a NVRAM (nonvolatile random access memory) 32, a RAM (random access memory) 34, a ROM (read-only memory) 36, a network I/F (interface) controller 38, a system I/F 22, a memory controller 24, an image memory 26, a buffer 28, and a HDDC (hard disk drive controller) 30. The operation device 12 includes a CPU 40, a RAM 42, a ROM 44, an input device 46, and a display device 48. The image input-output device 14 includes a CPU 50, a RAM 52, a ROM 54, an image reading unit 56, and an image forming unit 58.

The system controller 10, the operation device 12, and the image input-output device 14 are connected to each other via the image data bus 18. The image data bus 18 transmits image data and control commands.

The system controller 10 controls operations of the multifunction printer 100. For example, the CPU 20 reads a control program to perform functions described later from the ROM 36 by using the RAM 34 as a working area. The NVRAM 32 stores information of a whole system of the multifunction printer 100 including a system configuration, discharge tray information, and sheet information.

The network I/F controller 38 performs communication control via an external network. The CPU 20 commands the system I/F 22 to control transmission of data such as read image data and print image data processed in the multifunction printer 100. The image memory 26 provides a working storage area for temporarily storing read image data. The buffer 28 provides a temporal storage area for speed conversion of input and output image data in transmission of data. The HDDC 30 controls input and output of image data to and from the HDD 16 connected to the system controller 10 via the image data bus 18. The memory controller 24 controls input and output of image data to and from the image memory 26, the HDDC 30, and the image data bus 18.

The CPU 40 of the operation device 12 reads a control program of the operation device 12 from the ROM 44, controls screen display on the display device 48, and monitors input to the input device 46 by using the RAM 42 as a working area. The input device 46 receives an input command such as an operation setting, and the like, from an operator. The display device 48 notifies the operator of a system state and displays a warning.

The CPU 50 of the image input-output device 14 performs overall control of the image input-output device 14. The ROM 54 stores a program for controlling the image input-output device 14. The RAM 52 provides a working storage area for the CPU 50. The image reading unit 56 controls an optical scanner to read an image on an original document. The image forming unit 58 transfers and fixes a toner image or the like onto a transfer sheet and controls print output of print image data.

Accordingly, for example, the image data read by the image reading unit 56 is temporarily stored in the image memory 26 via the system I/F 22 and transferred to the HDD 16 via the buffer 28 and the image data bus 18. By contrast, the print image data is transferred from the HDD 16 via the system I/F 22 and temporarily stored in the image memory 26. Thereafter, the print image data is transferred to the image forming unit 58 via the image data bus 18 and printed out.

Figure 3:
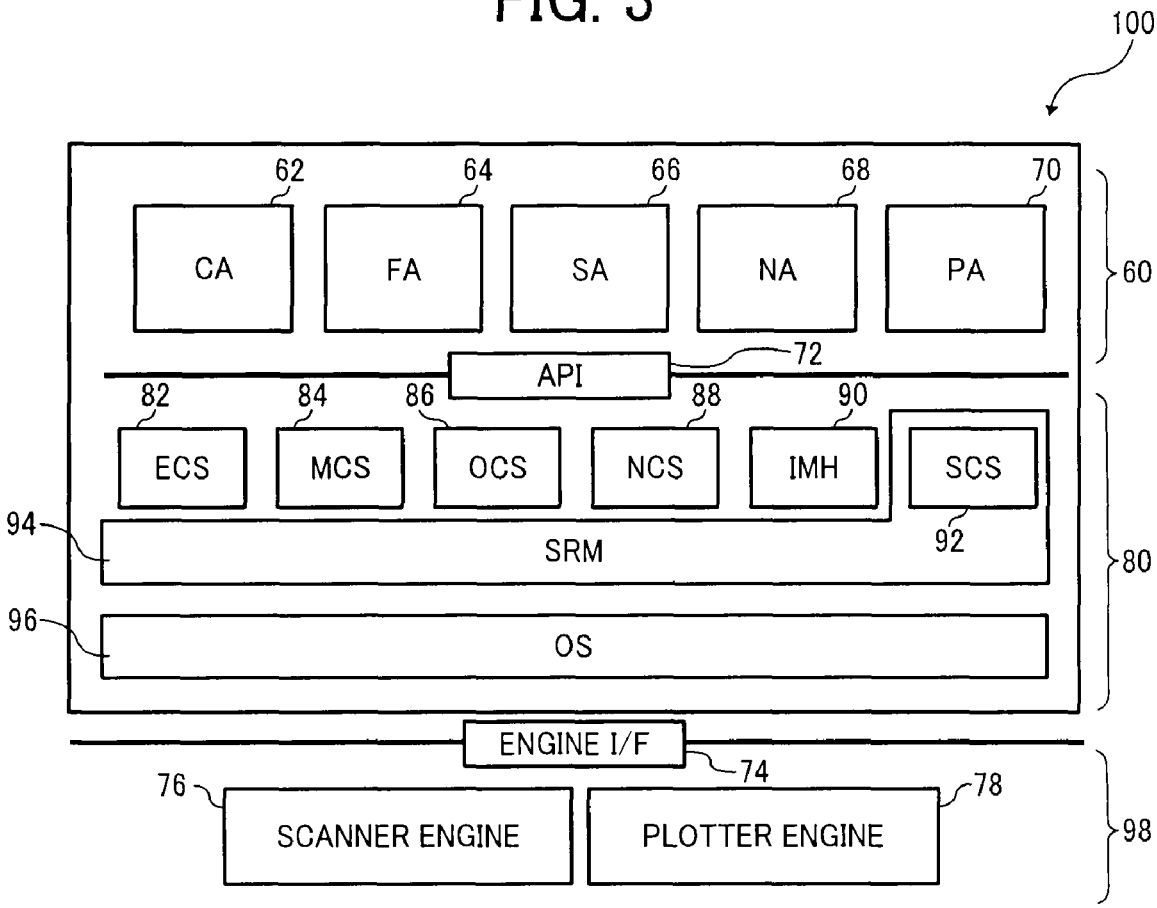
FIG. 3 is a block diagram of a software configuration of the multifunction printer shown in FIG. 1.

FIG. 3 illustrates a software configuration of the multifunction printer 100 according to the exemplary embodiment. The multifunction printer 100 further includes an application layer 60, an API (application program interface) 72, a platform layer 80, an engine I/F (interface) 74, and an engine layer 98. The application layer 60 includes a CA (copy application) 62, a FA (facsimile application) 64, a SA (scanner application) 66, a NA (net file application) 68, and a PA (printer application) 70. The platform layer 80 includes an ECS (engine control service) 82, a MCS (memory control service) 84, an OCS (operation control service) 86, a NCS (network control service) 88, an IMH (image memory handler) 90, a SCS (system control service) 92, a SRM (system resource manager) 94, and an OS (operating system) 96. The engine layer 98 includes a scanner engine 76 and a plotter engine 78.

The application layer 60 performs processing for user service related to image reading and image forming functions such as a printer function, a copier function, a facsimile function, a scanner function, and the like. The CA 62 performs a copier function. The FA 64 performs a facsimile function. The SA 66 performs a scanner function. The NA 68 performs a network file function. The PA 70 performs a printer function.

In the platform layer 80, the OS 96, the ECS 82, the MCS 84, the OCS 86, the NCS 88, the IMH 90, and the SCS 92 interpret processing requests from the CA 62, the FA 64, the SA 66, the NA 68, and the PA 70 to generate a request for acquiring hardware resources. The SRM 94 manages one or a plurality of hardware resources and adjusts the acquisition requests transmitted from the ECS 82, the MCS 84, the OCS 86, the NCS 88, the IMH 90, and the SCS 92. The OS 96 may include UNIX (registered trademark), WINDOWS (registered trademark), and any other operating systems.

The SCS 92 manages the CA 62, the FA 64, the SA 66, the NA 68, and the PA 70, controls a user interface (I/F) such as a system screen display or a LED display, manages hardware resources, and controls an interrupt application. The ECS 82 divides a job transmitted from the CA 62, the FA 64, the SA 66, the NA 68, and the PA 70 into a print process for one sheet of an original document or one transfer sheet, and manages the print process to control a reading operation and a printing operation. The MCS 84 manages image data included in one job as a file. The OCS 86 controls the operation device 12 (depicted in FIG. 2) as an interface between the operator and the multifunction printer 100. The IMH 90 manages a memory area temporarily storing image data and controls image-related processing including image transfer. The NCS 88 controls the network I/F controller 38 (depicted in FIG. 2) to connect the multifunction printer 100 to Ethernet (registered trademark) and provides applications requesting network I/O (input and output) with a commonly available service.

The API 72 is provided between the platform layer 80 and the application layer 60. The platform layer 80 accepts processing requests from the CA 62, the FA 64, the SA 66, the NA 68, and the PA 70 by using a predefined function included in the API 72.

The above group of software of the multifunction printer 100 may control the hardware resources such as the image reading unit 56, the image forming unit 58, the HDD 16 (depicted in FIG. 2), and the like, to perform various types of setting, image reading, and print output in response to a user command via the user interface and an input from an external device via the network.

Various combinations of the above applications, the control services, and the hardware resources are possible, and addition and deletion thereof are possible so as to support a specific use and machine type, for example. Although the software of the multifunction printer 100 includes a platform configuration formed by extracting a common part from the CA 62, the FA 64, the SA 66, the NA 68, and the PA 70, and the ECS 82, the MCS 84, the OCS 86, the NCS 88, the IMH 90, and the SCS 92, the hardware and the software configurations of the multifunction printer 100 are not limited to the configurations shown in the above-described exemplary embodiment, and do not exclude a different configuration.

Figure 4:
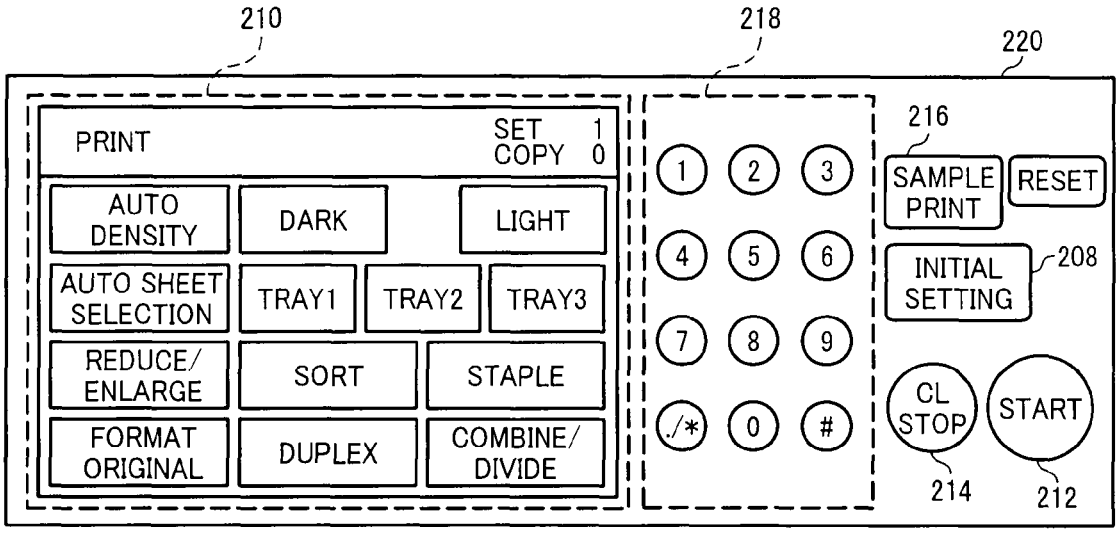
FIG. 4 is a schematic view of a control panel included in the multifunction printer shown in FIG. 1.

FIG. 4 is a schematic view of the control panel 220 of the multifunction printer 100 according to the exemplary embodiment. The control panel 220 includes a START key 212, a CL/STOP key 214, a SAMPLE PRINT key 216, an INITIAL SETTING key 208, a numeric keypad 218, and a touch panel 210.

The START key 212 accepts a command to start printing. The CL/STOP key 214 accepts a command to stop printing or to cancel an input command. The SAMPLE PRINT key 216 accepts a command to start sample print output. The INITIAL SETTING key 208 accepts a command to display an initial setting screen. The numeric keypad 218 is used to enter values. The touch panel 210 combines a display device and an input device.

The operator performs print settings of specifying duplex printing, combine printing, and division printing, selection of a paper tray, density adjustment, and the like, in advance by touching a GUI (graphical user interface) displayed on the touch panel 210, and presses the START key 212 to issue a command to the multifunction printer 100 to start the job. Also, the operator may display the initial setting screen by pressing the INITIAL SETTING key 208 and set discharge tray information including a user-specified discharge tray and a priority order of the discharge trays by touching the GUI on the initial setting screen. Also, the operator may issue a command to the multifunction printer 100 to start sample print output by pressing the SAMPLE PRINT key 216. Such operations of the control panel 220 are detected by the OCS 86 (depicted in FIG. 3) and reported to the ECS 82, the MCS 84, the OCS 86, the NCS 88, the IMH 90, and the SCS 92 of the platform layer 80 (depicted in FIG. 3).

Figure 5:
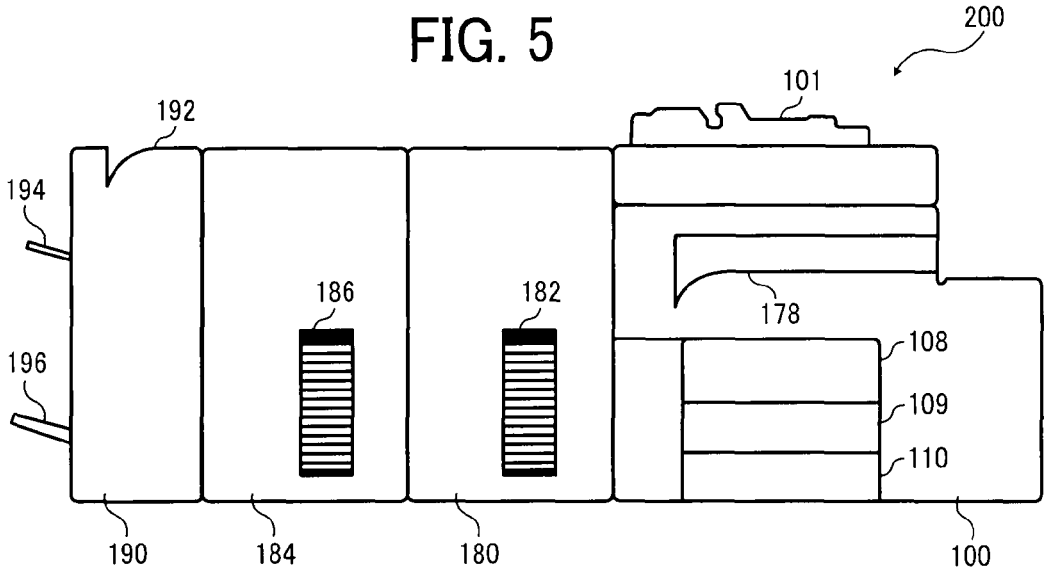
FIG. 5 is a schematic view of an image forming system including the multifunction printer shown in FIG. 1.

FIG. 5 illustrates an image forming system 200 including the multifunction printer 100 according to an exemplary embodiment. The image forming system 200 includes the multifunction printer 100, stackers 180 and 184, and a finisher 190. The multifunction printer 100 includes the ADF 101, the paper trays 108, 109, and 110, and a body tray 178. The stacker 180 includes a first stacker tray 182. The stacker 184 includes a second stacker tray 186. The finisher 190 includes an upper tray 192, an upper finisher tray 194, and a lower finisher tray 196.

The stackers 180 and 184, and the finisher 190, have a serial connection to the multifunction printer 100 and serve as post-processing devices. They are controlled by the multifunction printer 100 and perform image forming, sheet conveyance, and post-processing operations in conjunction with the multifunction printer 100.

The body tray 178 serves as a discharge tray of the multifunction printer 100. The first stacker tray 182 of the stacker 180 and the second stacker tray 186 of the stacker 184 may stack printed transfer sheets and may serve as discharge trays for receiving printed transfer sheets sent from the multifunction printer 100, respectively. The upper tray 192, the upper finisher tray 194, and the lower finisher tray 196 of the finisher 190 also may serve as discharge trays for receiving printed transfer sheets sent from the multifunction printer 100, respectively.

Therefore, in the image forming system 200, the body tray 178, the first stacker tray 182, the second stacker tray 186, the upper tray 192, the upper finisher tray 194, and the lower finisher tray 196 may be specified by the multifunction printer 100 as a discharge tray. According to the exemplary embodiment, a discharge tray for sample print output is determined based on discharge tray setting information, information about a discharge tray specified for another print job, information about state of transfer sheets stacked on each discharge tray, information about available sheets, and the like. In addition, each of the multifunction printer 100, the stackers 180 and 184, and the finisher 190 of the image forming system 200 has a sensor for detecting that the number of transfer sheets stacked on the respective trays have reached their capacity and are full. For example, the multifunction printer 100 sends an inquiry to or receives a notification from the devices connected via the serial connection to determine whether or not the number of transfer sheets stacked on the discharge tray, which may be specified by the multifunction printer 100, has reached its capacity, that is, whether or not the discharge tray is full.

Figure 6:
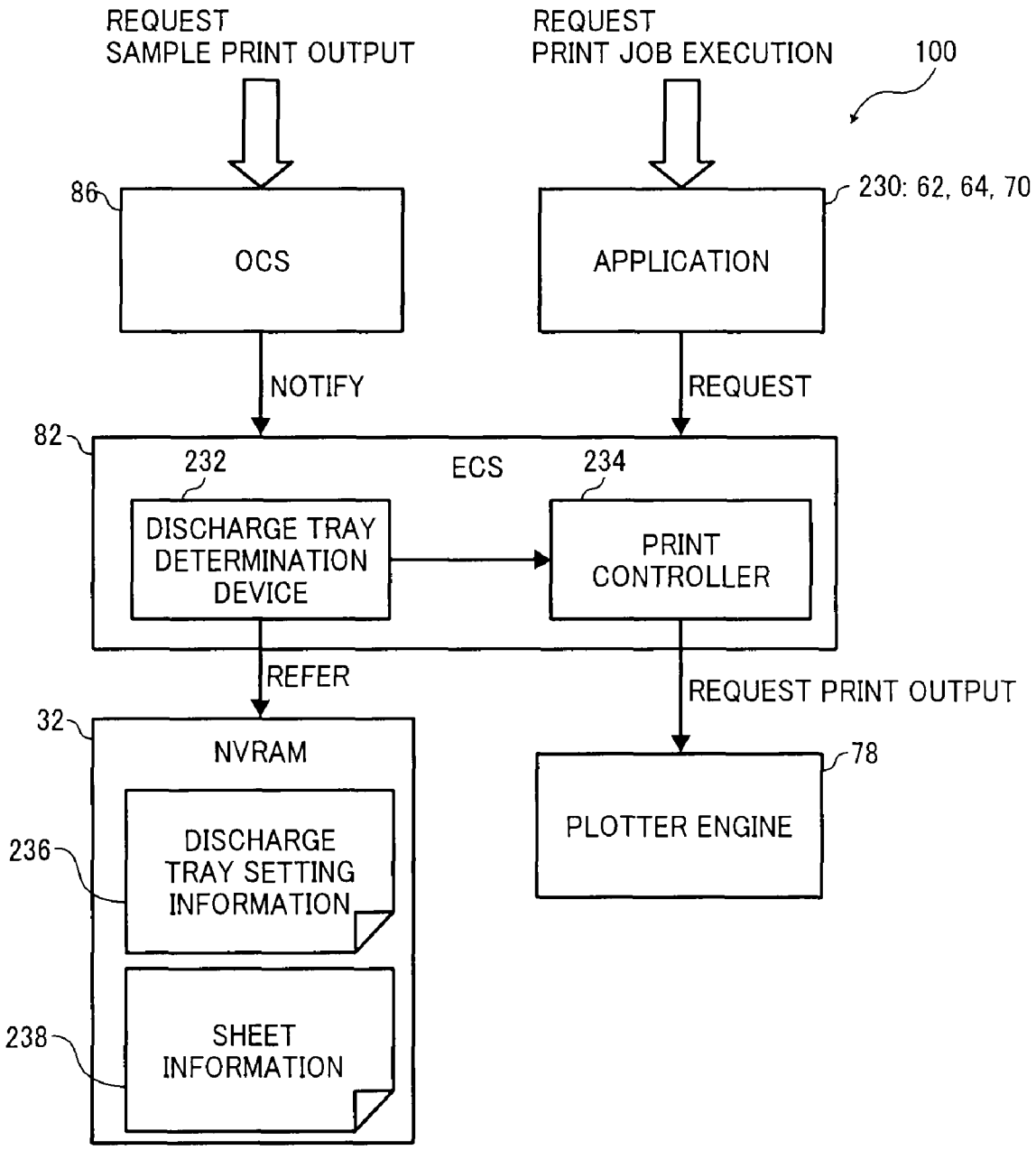
FIG. 6 is a block diagram of elements performing a sample print output function included in the multifunction printer shown in FIG. 1.

Referring to FIG. 6, a description is now given of a sample print output function.

FIG. 6 is a block diagram illustrating the sample print output function of the multifunction printer 100 according to the exemplary embodiment. The multifunction printer 100 further includes applications 230. The ECS 82 includes a discharge tray determination device 232 and a print controller 234.

The applications 230 correspond to the applications including the CA 62, the PA 70 or the FA 64 included in the application layer 60 (depicted in FIG. 3) and performing print output. The applications 230 receive a job execution request from an operator via the control panel 220 (depicted in FIG. 4), a parallel or serial interface (e.g., IEEE1294 or USB), or a network interface, and issue a print job start request including print output processing (e.g., a print job) to the ECS 82. The print job start request includes print parameters related to various print output such as discharge tray settings, edit settings including duplex printing or combine printing, post-processing settings, sheet settings, number of copies settings, print density settings, and the like.

When the ECS 82 receives the print job start request, the print controller 234 divides the print job into print processes for one transfer sheet according the print parameters included in the print job start request to manage a schedule of execution of the print job. As the print job proceeds, the print controller 234 checks whether or not print execution conditions are satisfied, for example, whether or not transfer sheets are stacked on the paper trays 108, 109, and 110 (depicted in FIG. 5) and whether or not a proper amount of toner remains, and issues a print output request corresponding to the print processes for one transfer sheet to the plotter engine 78 to control print output. Upon receipt of the request, the plotter engine 78 executes printing operation corresponding to the print processes for one transfer sheet, so that a printed sheet is conveyed to a specified discharge tray.

A detailed description of a function of the ECS 82 is now given, using a copy job executed by the CA 62 as an example.

When the CA 62 receives a request to execute a copy job from an operator, the ADF 101 (depicted in FIG. 1) starts feeding an original document. Under control of the ECS 82, after the scanner engine 76 (depicted in FIG. 3) reads an image on the original document, the HDD 16 (depicted in FIG. 2) temporarily stores read image data for one page of original document having m pages. With use of an electronic sort function, the ECS 82 issues a request for copying m pages per one set for n sets to the plotter engine 78 to perform copying a predetermined set. Also in a case of print job executed by the PA 70, when the PA 70 receives a command to perform a print job from a host computer or the like, print image data for one transfer sheet is generated, and the ECS 82 issues a request for printing m pages for n sets to the plotter engine 78 to perform printing a predetermined set.

When the OCS 86 detects that the SAMPLE PRINT key 216 (depicted in FIG. 4) is pressed, the OCS 86 notifies a request for sample print output to the ECS 82. Upon receipt of the request, the print controller 234 interrupts a current print job to perform a predetermined print process for sample print output. The predetermined print process may be a print process of a current print job, for example, a copy of a print process for one transfer sheet, for which a print output request is to be issued to the plotter engine 78. However, the predetermined print process is not limited to the above, and may be a print process of a current print job, for example, a copy of a print process which is processed at a time of sample print output request. Alternatively, the predetermined print process may be optimized in order to confirm a top resist error and a skew image density modulation, correspond to sample image data prepared in advance, and have print settings according to settings for a current print process in order to confirm an image quality based on a sheet size and a sheet type to be used. In addition, the predetermined print process may be a print process for a single transfer sheet or for a plurality of transfer sheets.

The discharge tray determination device 232 refers to discharge tray setting information 236 and sheet information 238 stored in the NVRAM 32 and selects a discharge tray satisfying necessary conditions from among available discharge trays, which may be specified by the multifunction printer 100, as a discharge tray for sample print output. Also, the discharge tray determination device 232 confirms a discharge tray specified for a current print job and a stack state of transfer sheets on each tray and determines a discharge tray for sample print output. The print controller 234 specifies the discharge tray determined by the discharge tray determination device 232 and issues a request for print output to the plotter engine 78.

The discharge tray setting information 236 referred to in determination of the discharge tray may be entered using the control panel 220 (depicted in FIG. 4) when sample print output is requested. Alternatively, the discharge tray setting information 236 may be set in advance as setting information of sample print output by touching a GUI setting screen displayed on the touch panel 210 (depicted in FIG. 4) by pressing the INITIAL SETTING key 208. The sheet information 238 also referred to in determination of the discharge tray may include information about an available sheet size and sheet type, and may be acquired in advance as system information of the multifunction printer 100 or information about the devices (e.g., the stackers 180 and 184, and the finisher 190 depicted in FIG. 5) connected to the multifunction printer 100.

Figure 7:
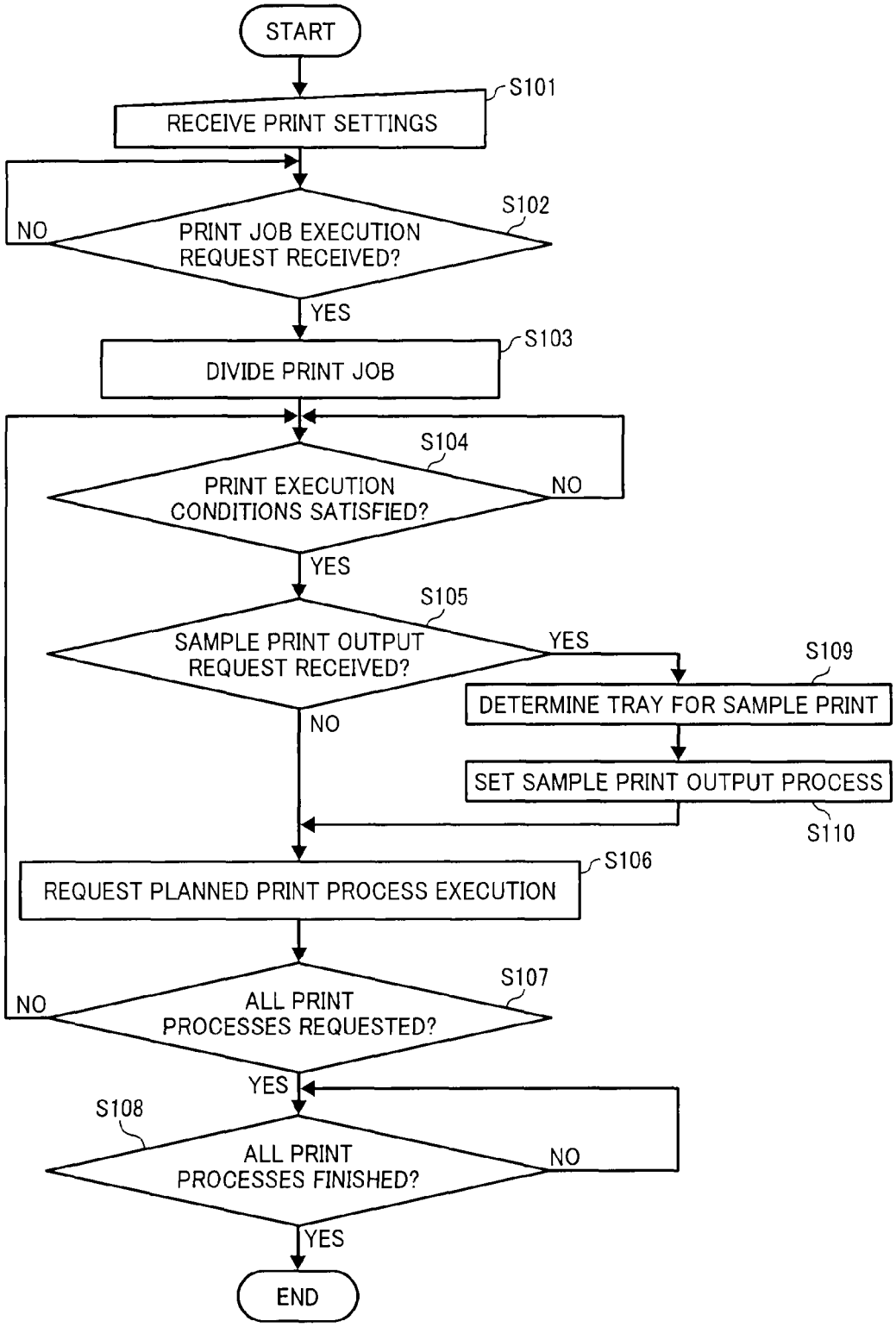
FIG. 7 is a flowchart illustrating steps in a process of sample print output performed by the multifunction printer shown in FIG. 1.

Referring to FIG. 7, a description is now given of steps in a process of sample print output. FIG. 7 is a flowchart illustrating steps in the process of sample print output executed by the multifunction printer 100 according to the exemplary embodiment.

In step S101, the print controller 234 (depicted in FIG. 6) receives print settings from an operator and prepares for starting a print job. In step S102, for example, the print controller 234 determines whether or not it receives a print job execution request from the operator pressing the START key 212 (depicted in FIG. 4). When the print controller 234 determines that it does not receive the request (e.g., if NO is selected in step S102), the processing returns to step S102 and is repeated until the print controller 234 receives a print job execution request.

When the print controller 234 determines that it has received the request (e.g., if YES is selected in step S102), the applications 230 issue a print job start request to the ECS 82 as illustrated in FIG. 6, and the print controller 234 divides the print job into a print process for one transfer sheet according print parameters included in the print job start request to manage a schedule of execution of the print job, in step S103. The print parameters included in the print job start request include a specification of a discharge tray for normal printing.

In step S104, the print controller 234 determines whether or not print execution conditions for a print process which is planned to be executed are satisfied. The print execution conditions include, for example, confirmation items regarding whether or not the paper tray 108, 109, or 110 (depicted in FIG. 5) specified as a paper tray for performing the planned print process is properly set, whether or not the paper tray has sufficient transfer sheets, and whether or not a sufficient amount of toner remains. When the print execution conditions are not satisfied (e.g., if NO is selected in step S104), the print controller 234 issues an error message and the processing is repeated until the print execution conditions are satisfied. When the print controller 234 determines that the print execution conditions are satisfied (e.g., if YES is selected in step S104), the print controller 234 determines whether or not it receives a sample print output request in step S105.

When the print controller 234 determines that it has not received the sample print output request (e.g., if NO is selected in step S105), the print controller 234 issues a request for performing the planned print process to the plotter engine 78 (depicted in FIG. 6) in step S106. Upon receipt of the request, the plotter engine 78 executes the print process, so that the printed sheet is conveyed to the discharge tray set in step S101.

In step S107, the print controller 234 determines whether or not all print processes included in the print job have been requested. When all print processes have been requested (e.g., if YES is selected in step S107), the print controller 234 determines whether or not the plotter engine 78 has properly finished performing all print processes included in the print job in step S108. When they have not been properly finished (e.g., if NO is selected in step S108), the processing is repeated until all print processes have been properly finished. When all print processes have been properly finished (e.g., if YES is selected in step S108), the print job is finished. When all print processes have not been requested (e.g., if NO is selected in step S107), step S104 and the subsequent steps are repeated to perform all print processes included in the print job.

When the print controller 234 determines that it has received the sample print output request (e.g., if YES is selected in step S105), the print controller 234 issues a request for determining a discharge tray for sample print output to the discharge tray determination device 232 (depicted in FIG. 6) and receives a determination result in step S109. Processing for determination of the discharge tray for the sample print output is described later. In step S110, the print controller 234 specifies the discharge tray determined by the discharge tray determination device 232 and interrupts a schedule to perform a predetermined print process for sample print output. Thereafter, in step S106, the print controller 234 issues the request for performing the print process for the sample print output to the plotter engine 78 to execute the sample print output, and the printed sheet is conveyed to the specified discharge tray. After the sample print output, in step S106 of a subsequent cycle, the initially planned print process which has been delayed due to the sample print output is to be executed.

Figure 8:
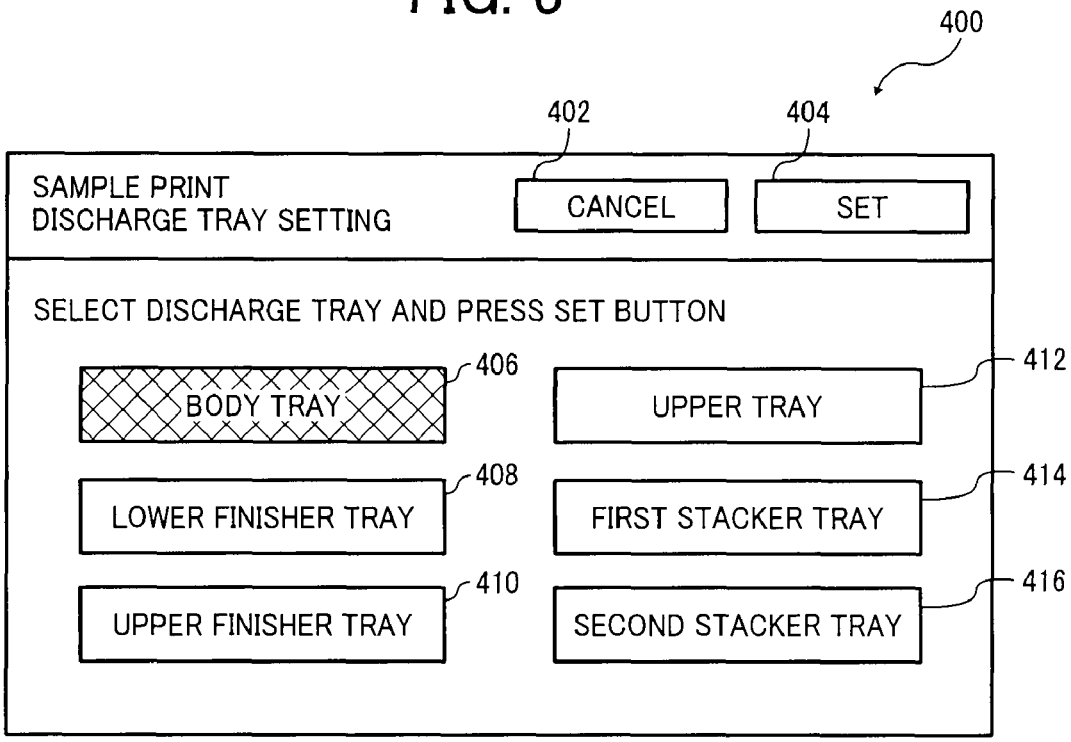
FIG. 8 illustrates a GUI (graphical user interface) included in the control panel shown in FIG. 4 for setting a user-specified discharge tray included in the image forming system shown in FIG. 5.

Referring to FIG. 8, a description is now given of a determination of the discharge tray for the sample print output. FIG. 8 illustrates a GUI 400 for setting a user-specified discharge tray according to the exemplary embodiment. The GUI 400 includes a CANCEL key 402, a SET key 404, discharge tray keys 406, 408, 410, 412, 414, and 416.

The GUI 400 is displayed on the touch panel 210 of the control panel 220 (depicted in FIG. 4) and shows a title indicating discharge tray settings for sample print output and a message for requesting selection of a discharge tray. The discharge tray keys 406, 408, 410, 412, 414, and 416 are used for selecting a discharge tray from available discharge trays which may be specified by the multifunction printer 100 and show names of the respective discharge trays. The GUI 400 may be displayed from a setting menus screen displayed by pressing the INITIAL SETTING key 208 of the control panel 220 (depicted in FIG. 4), for example.

The discharge tray keys 406, 408, 410, 412, 414, and 416 correspond to the respective available discharge trays. When an operator presses one of the discharge tray keys 406, 408, 410, 412, 414, and 416 of the GUI 400 displayed on the touch panel 210, a memory (e.g., the RAM 34 depicted in FIG. 2) stores the selected discharge tray. For example, in FIG. 8, the discharge tray specification key 406 showing "BODY TRY" is highlighted to indicate that it is selected. When the operator presses the SET key 404, the NVRAM 32 (depicted in FIG. 2) stores the selected discharge tray as a user-specified discharge tray. Pressing the CANCEL key 402 cancels the above setting.

Figure 9:
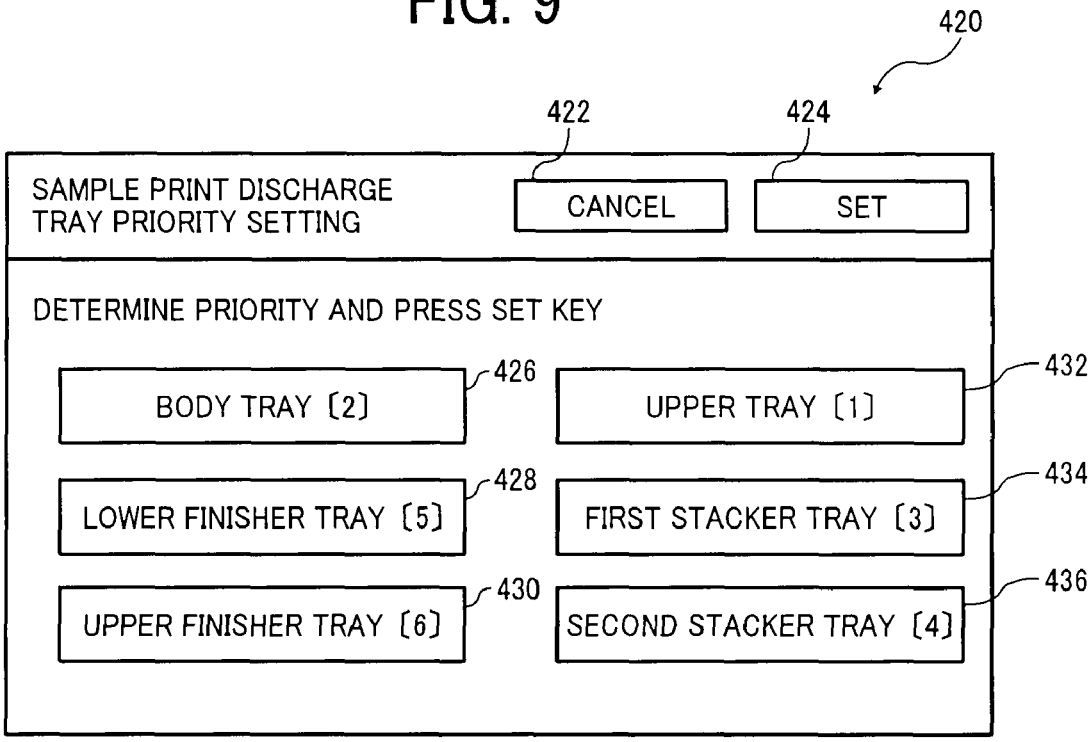
FIG. 9 illustrates a GUI included in the control panel shown in FIG. 4 for setting an order of priority in determining a discharge tray for sample print output included in the image forming system shown in FIG. 5.

FIG. 9 illustrates a GUI 420 for setting an order of priority in determination of a discharge tray for sample print output according to the exemplary embodiment. The GUI 420 includes a CANCEL key 422, a SET key 424, priority order keys 426, 428, 430, 432, 434, and 436.

The GUI 420 is displayed on the touch panel 210 of the control panel 220 (depicted in FIG. 4) and shows a title indicating a setting of a priority order of a discharge tray used for sample print output and a message for requesting selection of a discharge tray. Pressing the priority order keys 426, 428, 430, 432, 434, and 436 may specify a priority order of available discharge trays which may be specified by the multifunction printer 100. The respective priority order keys 426, 428, 430, 432, 434, and 436 show a name of a discharge tray and a priority number thereof as illustrated in FIG. 9. The GUI 420 may be displayed from the setting menus screen displayed by pressing the INITIAL SETTING key 208 of the control panel 220 (depicted in FIG. 4), for example.

When the operator presses the priority order keys 426, 428, 430, 432, 434, and 436 corresponding to the respective discharge trays, the CPU 20 (depicted in FIG. 2) prioritizes the corresponding discharge trays to be stored in memory. For example, the priority order may be determined according to the order of pressing the priority order keys 426, 428, 430, 432, 434, and 436.

FIG. 9 shows an example of a case in which the priority order key 432 showing "UPPER TRAY [1]", the priority order key 426 showing "BODY TRAY [2]", the priority order key 434 showing "FIRST STACKER TRAY [3]", the priority order key 436 showing "SECOND STACKER TRAY [4]", the priority order key 428 showing "LOWER FINISHER TRAY [5]", and the priority order key 430 showing "UPPER FINISHER TRAY [6]" have been pressed in this order. The memory stores the discharge trays associated with its priority numbers. When the operator presses the SET key 424, the NVRAM 32 (depicted in FIG. 2) stores the priority order stored in the memory as discharge tray priority information. Pressing the CANCEL key 422 may cancel the above setting.

FIG. 10 illustrates discharge tray priority information 380 set by using the GUI 420 (depicted in FIG. 9) according to the exemplary embodiment. The discharge tray priority information 380 includes fields 380A and 380B.

The field 380A lists the priority numbers associated with the respective available discharge trays. The field 380B lists the corresponding discharge trays. The above-described discharge tray setting information 236 (depicted in FIG. 6) includes the discharge tray priority information 380 and the user-specified discharge tray information set by using the GUI 400 as illustrated in FIG. 8. Therefore, the discharge tray determination device 232 (depicted in FIG. 6) refers to the discharge tray setting information 236 and assigns the highest priority to the user-specified discharge tray satisfying necessary conditions to determine the discharge tray having the highest possible priority as a discharge tray for sample print output.

FIG. 11 illustrates available sheet type information 300 referred to in determining a discharge tray according to the exemplary embodiment. The available sheet type information 300 includes columns 304, 306, 308, and 310, rows 312, 314, 316, 318, 320, and 322, and a cell 324.

The columns 304, 306, 308, and 310 specify a sheet type, respectively, and the columns 312, 314, 316, 318, 320, and 322 specify a discharge tray, respectively. The available sheet type information 300 offers information about whether or not the respective discharge trays accept the respective sheet types. The cell 324 may be specified by a combination of the columns 312, 314, 316, 318, 320, and 322 and the columns 304, 306, 308, and 310, and includes information about whether or not the specified discharge tray accepts the specified sheet type, for example, "available" or "unavailable". The available sheet type information 300 indicates that the body tray 178 (depicted in FIG. 5) may receive plain paper, OHP transparencies, thick paper, and gloss paper. The discharge tray determination device 232 refers to the available sheet type information 300 to determine whether or not the respective discharge trays may receive a transfer sheet specified for the print process for sample print output.

FIG. 12 illustrates available sheet size information 350 referred to in determination of a discharge tray according to the exemplary embodiment. The available sheet size information 350 includes columns 354, 356, 358, and 360, rows 362, 364, 366, 368, 370, and 372, and a cell 374.

The columns 354, 356, 358, and 360 specify a sheet size, respectively, and the rows 362, 364, 366, 368, 370, and 372 specify a discharge tray, respectively. The available sheet size information 350 offers information about whether or not the respective discharge trays accept the respective sheet sizes. The cell 374 may be specified by a combination of the rows 362, 364, 366, 368, 370, and 372 and the columns 354, 356, 358, and 360, and includes information about whether or not the specified discharge tray accepts the specified sheet size, for example, "available" or "unavailable". The available sheet size information 350 indicates that the body tray 178 (depicted in FIG. 5) may receive A3, B4, A4, and B5 size sheets. The discharge tray determination device 232 refers to the available sheet size information 350 to determine whether or not the respective discharge trays may receive a transfer sheet specified for the print process for sample print output. The sheet information 238 (depicted in FIG. 6) includes the available sheet type information 300 and the available sheet size information 350, both of which are included in the system information.

Figure 13:
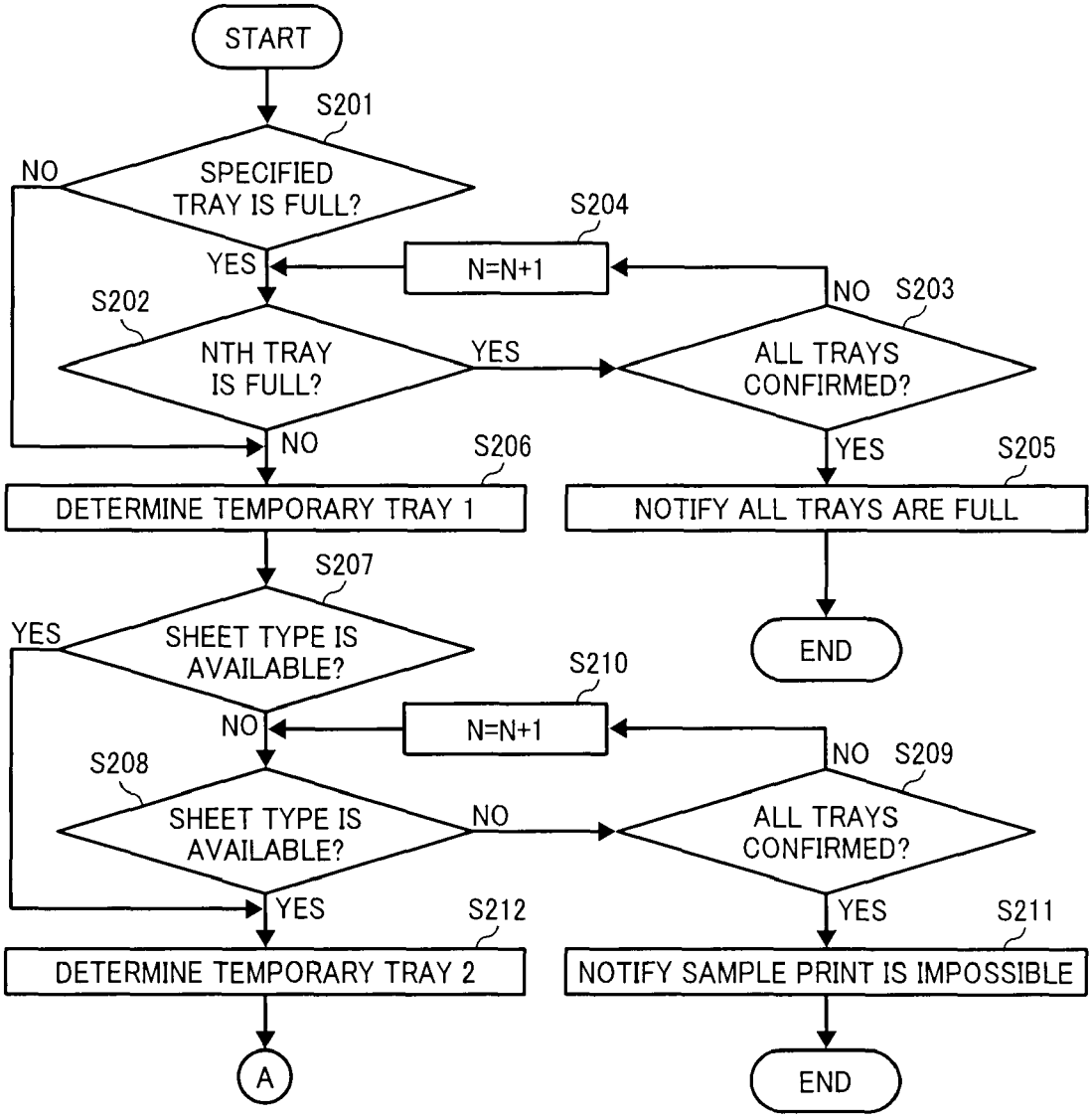
FIG. 13 is a flowchart illustrating discharge tray determination processing for sample print output performed by the multifunction printer shown in FIG. 1.
Figure 14:
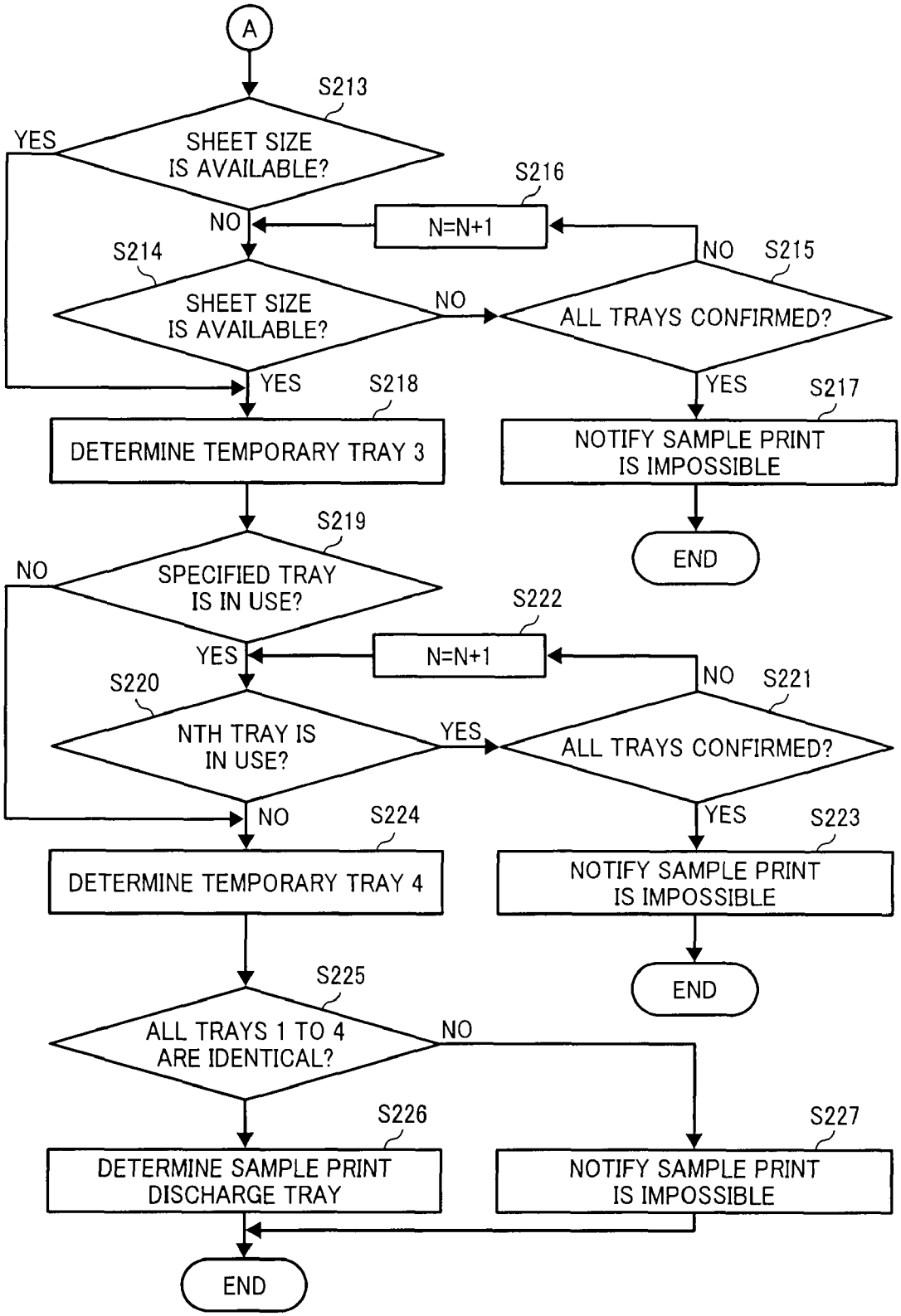
FIG. 14 is a flowchart illustrating subsequent processing of discharge tray determination for sample print output performed by the multifunction printer shown in FIG. 1.

Referring to FIGS. 13 and 14, a description is now given steps in a process of determining a discharge tray for sample print output. FIGS. 13 and 14 illustrate a flowchart of processing for determining a discharge tray for sample print output in the multifunction printer 100 according to the exemplary embodiment.

The processing starts when the print controller 234 (depicted in FIG. 6) issues a request for determining a discharge tray for sample print output in step S109 as illustrated in FIG. 7. In step S201, a controller (e.g., the CPU 20 depicted in FIG. 2) determines whether or not the user-specified discharge tray is full. When the CPU 20 determines that the user-specified discharge tray is not full (e.g., if NO is selected in step S201), a memory (e.g., the RAM 34 depicted in FIG. 2) stores the user-specified discharge tray as a temporary tray 1 for the sample print output.

When the CPU 20 determines that the user-specified discharge tray is full (e.g., if YES is selected in step S201), the CPU 20 refers to the discharge tray priority information 380 to determine whether or not a Nth discharge tray (e.g., a Nth-priority tray) is full in step S202. N represents a natural number including 1 to the number Nmax of available discharge trays, and an initial value N is set at 1. Determination is performed for discharge trays from a discharge tray having the highest priority to a discharge tray having the lowest priority. When the CPU 20 determines that the Nth discharge tray is not full (e.g., if NO is selected in step S202), the memory stores the Nth discharge tray as the temporary tray 1 in step S206.

When the CPU 20 determines that the Nth discharge tray is full (e.g., if YES is selected in step S202), the CPU 20 determines whether or not all available discharge trays have been confirmed in step S203, that is, the number N is identical to the number Nmax of available discharge trays. When the CPU 20 determines that all available discharge trays have not yet been confirmed (e.g., if NO is selected in step S203), the priority number N is changed to a priority number N+1 in step S204, and the processing returns to step S202. When the CPU 20 determines that all available discharge trays have been confirmed (e.g., if YES is selected in step S203), the touch panel 210 (depicted in FIG. 4) displays a message that all discharge trays are full in step S205, for example, and the processing ends.

When the user-specified discharge tray is set as the temporary tray 1 for sample print output in step S206, the CPU 20 refers to the available sheet type information 300 (depicted in FIG. 11) to determine whether or not the user-specified discharge tray may accept the sheet type specified for the print process for sample print output in step S207. When the CPU 20 determines that the user-specified discharge tray may accept the specified sheet type (e.g., if YES is selected in step S207), the memory stores the user-specified discharge tray as a temporary tray 2 for sample print output in step S212, and the processing proceeds to point A.

When the CPU 20 determines that the user-specified discharge tray may not accept the specified sheet type (e.g., if NO is selected in step S207), the CPU 20 refers to the discharge tray priority information 380 (depicted in FIG. 10) and the available sheet type information 300 to determine whether or not the Nth discharge tray may accept the specified sheet type in step S208. An initial value N is also set to 1, and determination is performed for discharge trays from a discharge tray having the highest priority to a discharge tray having the lowest priority. When the CPU 20 determines that the Nth discharge tray may accept the specified sheet type (e.g., if YES is selected in step S208), the memory stores the Nth discharge tray as the temporary tray 2 in step S212.

When the CPU 20 determines that the Nth discharge tray may not accept the specified sheet type (e.g., if NO is selected in step S208), the CPU 20 determines whether or not all available discharge trays have been confirmed in step S209. When the CPU 20 determines that all available discharge trays have not yet been confirmed (e.g., if NO is selected in step S209), the priority number N is changed to a priority number N+1 in step S210, and the processing returns to step S208. When the CPU 20 determines that all available discharge trays have been confirmed (e.g., if YES is selected in step S209), the touch panel 210 displays a message indicating that the sample print output is impossible in step S211, for example, and the processing ends.

In FIG. 14, the processing starts at point A, and the CPU 20 refers to the available sheet size information 350 (depicted in FIG. 12) to determine whether or not the user-specified discharge tray may accept the sheet size specified for the print process for sample print output in step S213. When the CPU 20 determines that the user-specified discharge tray may accept the specified sheet size (e.g., if YES is selected in step S213), the memory stores the user-specified discharge tray as a temporary tray 3 for sample print output in step S218.

When the CPU 20 determines that the user-specified discharge tray may not accept the specified sheet size (e.g., if NO is selected in step S213), the CPU 20 refers to the discharge tray priority information 380 and the available sheet size information 350 to determine whether or not the Nth discharge tray may accept the specified sheet size in step S214. An initial value N is also set to 1, and determination is performed for discharge trays from a discharge tray having the highest priority to a discharge tray having the lowest priority. When the CPU 20 determines that the Nth discharge tray may accept the specified sheet size (e.g., if YES is selected in step S214), the memory stores the Nth discharge tray as a temporary tray 3 in step S218.

When the CPU 20 determines that the Nth discharge tray may not accept the specified sheet size (e.g., if NO is selected in step S214), the CPU 20 determines whether or not all available discharge trays have been confirmed in step S215. When the CPU 20 determines that all available discharge trays have not yet been confirmed (e.g., if NO is selected in step S215), the priority number N is changed to a priority number N+1 in step S216, and the processing returns to step S214. When the CPU 20 determines that all available discharge trays have been confirmed (e.g., if YES is selected in step S215), the touch panel 210 displays a message that the sample print output is impossible in step S217, for example, and the processing ends.

When the user-specified discharge tray is set as the temporary tray 3 for the sample print output in step S218, the CPU 20 confirms a setting of a discharge tray used for a print job other than the sample print output to determine whether or not the user-specified discharge tray is in use for the print job in step S219. The CPU 20 inquires the print controller 234 (depicted in FIG. 6) to determine whether or not the user-specified discharge tray is in use in step S219 and step S220 described below, since the print controller 234 manages a discharge tray used for the print based on the discharge tray settings included in the print job start request. When the CPU 20 determines that the user-specified discharge tray is not in use for another print job (e.g., if NO is selected in step S219), the memory stores the user-specified discharge tray as a temporary tray 4 in step S224.

When the CPU 20 determines that the user-specified discharge tray is in use for another print job (e.g., if YES is selected in step S219), the CPU 20 refers to the discharge tray priority information 380 (depicted in FIG. 10) to determine whether or not the Nth discharge tray is in use for another print job in step S220. An initial value N is also set to 1, and determination is performed for discharge trays from a discharge tray having the highest priority to a discharge tray having the lowest priority. When the CPU 20 determines that the Nth discharge tray is not in use for another print job (e.g., if NO is selected in step S220), the memory stores the Nth discharge tray as the temporary tray 4 in step S224.

When the CPU 20 determines that the Nth discharge tray is in use for another print job (e.g., if YES is selected in step S220), the CPU 20 determines whether or not all available discharge trays have been confirmed in step S221. When the CPU 20 determines that all available discharge trays have not yet been confirmed (e.g., if NO is selected in step S221), the priority number N is changed to a priority number N+1 in step S222, and the processing returns to step S220. When the CPU 20 determines that all available discharge trays have been confirmed (e.g., if YES is selected in step S221), the touch panel 210 displays a message that the sample print output is impossible in step S223, for example, and the processing ends.

As described above, the CPU 20 determines whether or not all discharge trays set as the temporary trays 1 to 4 are identical in step S225. When all discharge trays set as the temporary trays 1 to 4 are identical (e.g., if YES is selected in step S225), the CPU 20 defines the identical discharge tray as a discharge tray for the sample print output in step S226, and the processing ends. When all discharge trays set as the temporary trays 1 to 4 are not identical (e.g., if NO is selected in step S225), the touch panel 210 displays a message indicating that the sample print output is impossible in step S227, for example, and the processing ends.

Accordingly, the above processing flow as illustrated in FIGS. 13 and 14 may facilitate a search for a user-specified discharge tray or a highest prioritized discharge tray, to which a transfer sheet for sample print output is discharged, satisfying condition 1 that the discharge tray is not full, condition 2 that the sheet type specified for the print process for sample print output is available, condition 3 that the sheet size specified for the print process for sample print output is available, and condition 4 that the discharge tray is not used for another job. The processing flow may search for a discharge tray satisfying the conditions 1 to 4 and having a highest priority while giving top priority to the user-specified discharge tray. Thus, a most appropriate discharge tray for sample print output may be efficiently determined, thereby properly acknowledging an image quality of a printed sheet without decreasing productivity.

Figure 15A:
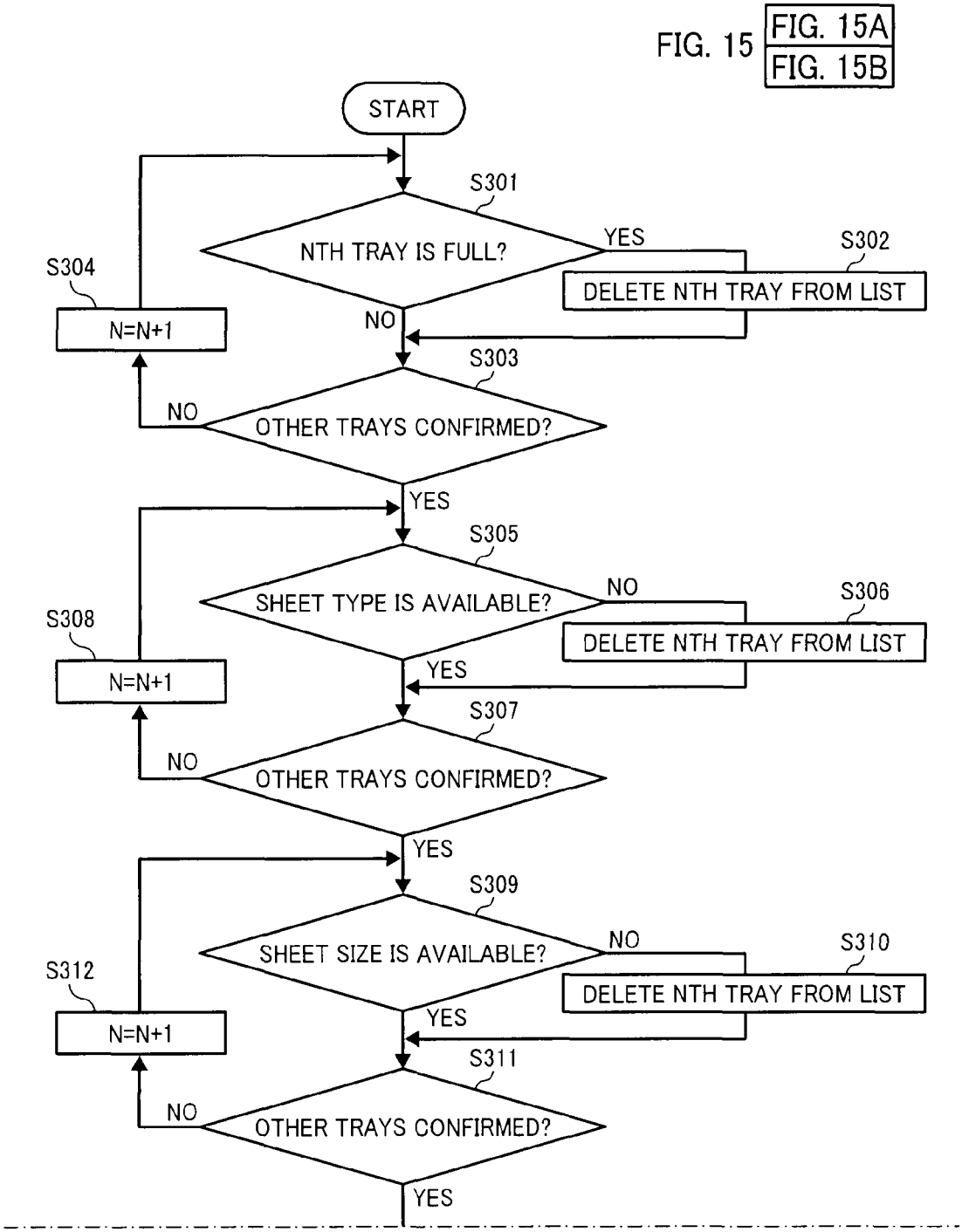
FIG. 15A is a flowchart illustrating discharge tray determination processing for sample print output performed by the multifunction printer shown in FIG. 1 according to another exemplary embodiment.
Figure 15B:
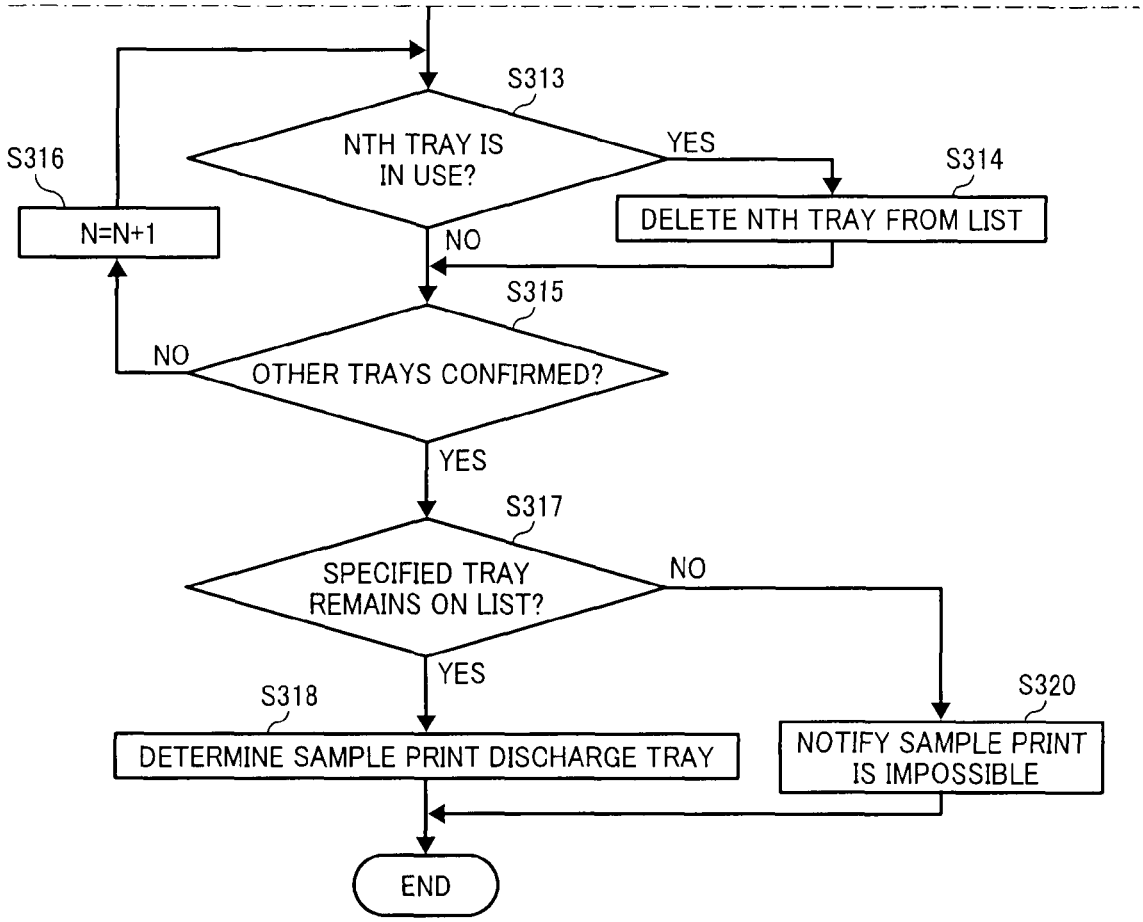
FIG. 15B is a flowchart illustrating subsequent processing of discharge tray determination for sample print output performed by the multifunction printer shown in FIG. 1 according to another exemplary embodiment.

FIGS. 15A and 15B illustrate a processing flow for determining a discharge tray for sample print output according to another exemplary embodiment. The processing starts when the print controller 234 (depicted in FIG. 6) issues a request for determining a discharge tray for sample print output in step S109 in FIG. 7. It is to be noted that a user-specified discharge tray has a highest priority and other discharge trays are prioritized according to the discharge tray priority information 380 (depicted in FIG. 10), and at the start of the processing, the CPU 20 (depicted in FIG. 2) generates a list in which the discharge trays are associated with their priority orders to be stored in a memory (e.g., the RAM 34 depicted in FIG. 2).

In step S301, an initial value N is set to 1, the CPU 20 determines whether or not an Nth discharge tray (e.g., an Nth-priority tray) is full. When the CPU 20 determines that the Nth discharge tray is not full (e.g., if NO is selected in step S301), the processing proceeds to step S303. When the CPU 20 determines that the Nth discharge tray is full (e.g., if YES is selected in step S301), the CPU 20 deletes the Nth discharge tray from the list in step S302, and the processing proceeds to step S303. The CPU 20 determines whether or not other discharge trays including a lowest prioritized discharge tray have been confirmed in step S303. When the CPU 20 determines that other discharge trays including the lowest prioritized discharge tray have not yet been confirmed (e.g., if NO is selected in step S303), the priority number N is changed to a priority number N+1 in step S304, and the processing returns to step S301. When the CPU 20 determines that other discharge trays including the lowest prioritized discharge tray have been confirmed (e.g., if YES is selected in step S303), the processing proceeds to step S305. In the processing flow from steps S301 to S304, since the CPU 20 determines whether or not all discharge trays including the discharge tray having the highest priority to the discharge tray having the lowest priority are full, a discharge tray which is not full with transfer sheets remains on the list. The priority orders of discharge trays remaining on the list are again established when the CPU 20 finishes confirmation of other discharge trays including the lowest prioritized discharge tray.

In step S305, an initial value N is set to 1, and the CPU 20 determines whether or not the Nth discharge tray may accept a sheet type specified for a print process for sample print output. When the CPU 20 determines that the Nth discharge tray may accept the specified sheet type (e.g., if YES is selected in step S305), the processing proceeds to step S307. When the CPU 20 determines that the Nth discharge tray may not accept the specified sheet type (e.g., if NO is selected in step S305), the CPU 20 deletes the Nth discharge tray from the list in step S306, and the processing proceeds to step S307. The CPU 20 determines whether or not all other discharge trays including the lowest prioritized discharge tray on the list have been confirmed in step S307. When the CPU 20 determines that all other discharge trays have not yet been confirmed (e.g., if NO is selected in step S307), the priority number N is changed to a priority number N+1 in step S308, and the processing returns to step S305. When the CPU 20 determines that all other discharge trays have been confirmed (e.g., if YES is selected in step S307), the processing proceeds to step S309. In the processing flow from steps S305 to S308, the CPU 20 determines whether or not the sheet type specified for the print process for sample print output is acceptable by all discharge trays from the highest prioritized discharge tray to the lowest prioritized discharge tray remaining on the list, so that discharge trays, to which a transfer sheet having the specified sheet type may be discharged, remain on the list. The priority orders of discharge trays remaining on the list are modified when the CPU 20 finishes confirmation of all other discharge trays.

In step S309, an initial value N is set to 1, and the CPU 20 determines whether or not the Nth discharge tray may accept a sheet size specified for the print process for sample print output. When the CPU 20 determines that the specified sheet size is acceptable by the Nth discharge tray (e.g., if YES is selected in step S309), the processing proceeds to step S311. When the CPU 20 determines that the Nth discharge tray may not accept the specified sheet size (e.g., if NO is selected in step S309), the CPU 20 deletes the Nth discharge tray from the list in step S310, and the processing proceeds to step S311. In step S311, the CPU 20 determines whether or not all other discharge trays including the lowest prioritized discharge tray have been confirmed. When the CPU 20 determines that all other discharge trays have not yet been confirmed (e.g., if NO is selected in step S311), the priority number N is changed to a priority number N+1 in step S312, and the processing returns to step S309. When the CPU 20 determines that all other discharge trays have been confirmed (e.g., if YES is selected in step S311), the processing proceeds to step S313. In the processing flow from steps S309 to S312, the CPU 20 determines whether or not the sheet size specified for the print process for sample print output is acceptable by all discharge trays including the highest prioritized discharge tray to the lowest prioritized discharge tray remaining on the list, so that discharge trays, to which a transfer sheet having the specified sheet size may be discharged, remain on the list. The priority orders of discharge trays remaining on the list are modified when the CPU 20 finishes confirmation of all other discharge trays.

In step S313, an initial value N is set to 1, and the CPU 20 determines whether or not the Nth discharge tray is in use for another print job. When the CPU 20 determines that the Nth discharge tray is not in use for another print job (e.g., if NO is selected in step S313), the processing proceeds to step S315. When the CPU 20 determines that the Nth discharge tray is in use for another print job (e.g., if YES is selected in step S313), the CPU 20 deletes the Nth discharge tray from the list in step S314, and the processing proceeds to step S315. In step S315, the CPU 20 determines whether or not all other discharge trays have been confirmed. When the CPU 20 determines that all other discharge trays have not yet been confirmed (e.g., if NO is selected in step S315), the priority number N is changed to a priority number N+1 in step S316, and the processing returns to step S313. When the CPU 20 determines that all other discharge trays have been confirmed (e.g., if YES is selected in step S315), the processing proceeds to step S317. In the processing flow from steps S313 to S316, the CPU 20 determines whether or not all discharge trays from the highest prioritized discharge tray to the lowest prioritized discharge tray remaining on the list are in use for another print job, so that an available discharge tray, which is not in use for another print job, may remain on the list.

In step S317, the CPU 20 looks up the list and determines whether or not any discharge trays remain on the list. When the CPU 20 determines that some discharge trays remain on the list (e.g., if YES is selected in step S317), the CPU 20 defines a discharge tray having a highest priority among the discharge trays remaining on the list as a discharge tray for sample print output in step S318, and the processing ends. When the CPU 20 determines that no discharge trays remain on the list (e.g., if NO is selected in step S317), the CPU 20 notifies a message that sample print output is impossible in step S320, and the processing ends.

Accordingly, the above processing flow as illustrated in FIGS. 15A and 15B may facilitate a search for a user-specified discharge tray or a highest prioritized discharge tray satisfying the above conditions 1 to 4 while giving top priority to the user-specified discharge tray, so that a most appropriate discharge tray for sample print output may be efficiently determined. It is to be noted that conditions to be satisfied in determining the discharge tray are not limited to those described above. In addition, processing according to this exemplary embodiment may omit some of steps S301, S305, S309, and S313 corresponding to the conditions 1 to 4, respectively. For example, even when the CPU 20 does not perform the determination as to whether or not the sheet type is acceptable (condition 2), the sheet type specified in the sheet settings for the print process for sample print output may be modified to a sheet type acceptable by the discharge tray selected in the determination so as to perform sample print output.

Figure 16A:
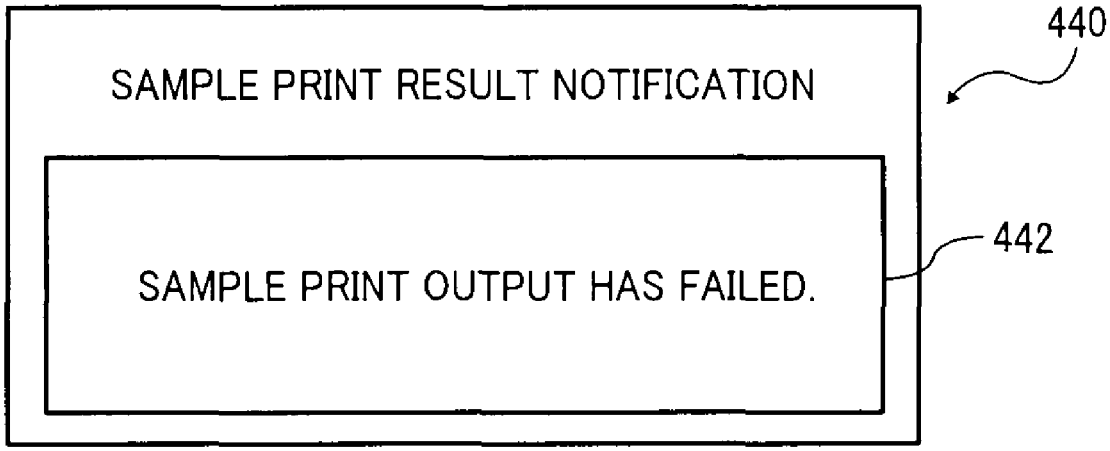
FIG. 16A illustrates a user notification screen displayed on the control panel shown in FIG. 4 indicating that sample print output is impossible.
Figure 16B:
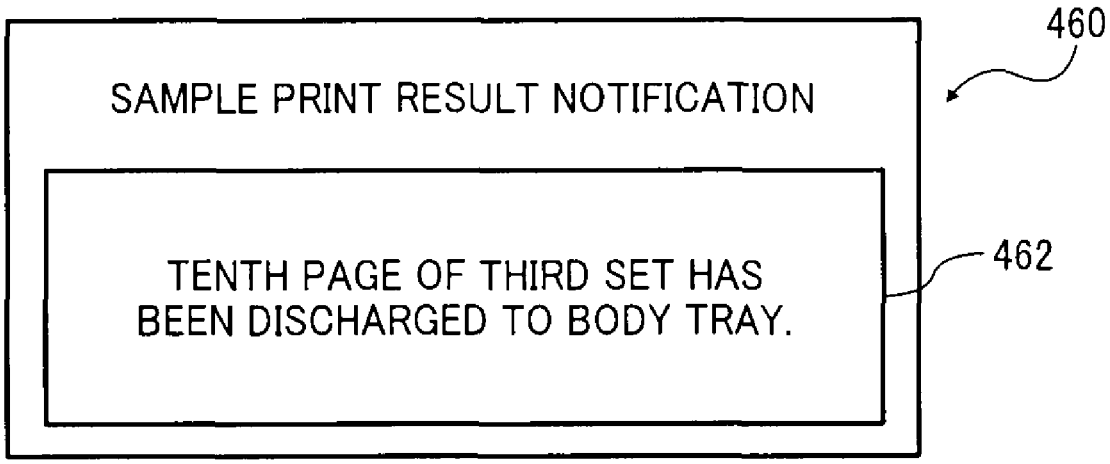
FIG. 16B illustrates a user notification screen displayed on the control panel shown in FIG. 4 indicating a sample print output processing result.

Referring to FIGS. 16A and 16B, a description is now given of a user notification regarding sample print output.

FIG. 16A illustrates a user notification screen 440. The user notification screen 440 includes a message 442. The user notification screen 440 is displayed on the touch panel 210 (depicted in FIG. 4) and serves as a user notification member. The message 442 notifies the user that the sample print output has failed. The notification is performed in steps S211 (depicted in FIG. 13), S218, S224, and S228 (depicted in FIG. 14), and S320 (depicted in FIG. 15).

FIG. 16B illustrates a user notification screen 460. The user notification screen 460 includes a message 462. The user notification screen 460, serving as a user notification member, is also displayed on the touch panel 210 (depicted in FIG. 4) when the sample print output is performed. The message 462 notifies a processing result of the sample print output including the number of sets and the number of pages corresponding to a predetermined print process for the sample print output and a name of a discharge tray for the sample print output. It is to be noted that the OCS 86 (depicted in FIG. 6) controls displaying the user notification screens 440 and 460 on the touch panel 210 when the sample print output is finished. Alternatively, however, for example, the user notification screens 440 and 460 may be displayed on a display of a host computer via a predetermined interface. The user notification in steps S211, S218, S224, S228, and S320 may also include a message showing an unsatisfied condition as a cause of error.

Notifying the user of the location of the discharge tray for a sample print output facilitates efficient printed image quality management. Also, notification of the number of sets and the number of pages corresponding to a predetermined print process for the sample print output enables the user to know when the sample print output is performed.

According to the exemplary embodiments described above, when a sample print output request is issued, an appropriate discharge tray may be automatically determined without interrupting a current printing operation. Therefore, an image forming apparatus, an image forming system, a program, and a recoding medium capable of efficiently showing an image quality of a printed sheet without decreasing productivity may be provided.

According to the exemplary embodiments, a multifunction printer (e.g., the multifunction printer 100 depicted in FIG. 1) having two or more of copying, printing, scanning, and facsimile functions, or the like, may serve as an image forming apparatus, however, a copier, a facsimile machine, a printer, and the like, also may serve as an image forming apparatus.

The above functions may be executed by using a computer-executable program written in legacy programming languages and object-oriented programming languages including assembler, C, C++, and Java (registered trademark), and may be stored in a machine-readable recording medium such as a ROM, a EEPROM, a EPROM, a flash memory, a flexible disk, a CD-ROM, a CD-RW, a DVD, a SD memory card, a MO, and the like, to be distributed.

This invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

As can be appreciated by those skilled in the art, although the present invention has been described above with reference to specific exemplary embodiments the present invention is not limited to the specific embodiments described above, and various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus for performing a sample print output, the image forming apparatus comprising:

a discharge tray determination device configured to determine a discharge tray for sample print output from one of a plurality of available discharge trays specifiable by the image forming apparatus, a sample print output being dischargeable to the plurality of available discharge trays; and a print controller configured to divide a print job into print processes and configured to control print output in response to a sample print output request, to cause a print process for a sample print output and for specifying a discharge tray determined by the discharge tray determination device to interrupt a print job.

2. The image forming apparatus according to claim 1, wherein the discharge tray determination device determines whether or not the available discharge trays satisfy a condition for discharge processing of a sample print output, and determines a discharge tray satisfying the condition as a discharge tray for sample print output.

3. The image forming apparatus according to claim 2, wherein the condition for discharge processing of a sample print output includes a first condition that a maximum capacity of transfer members is not stacked on a discharge tray, and wherein the discharge tray determination device determines whether or not the available discharge trays satisfy the first condition, and determines a discharge tray satisfying the first condition as a discharge tray for sample print output.

4. The image forming apparatus according to claim 2, wherein the condition for discharge processing of a sample print output includes a second condition that a discharge tray is not used for a current print job, and wherein the discharge tray determination device determines whether or not the available discharge trays satisfy the second condition, and determines a discharge tray satisfying the second condition as a discharge tray for sample print output.

5. The image forming apparatus according to claim 2, wherein the condition for discharge processing of a sample print output includes a third condition that a discharge tray accepts a print setting for a print process for a sample print output, and wherein the discharge tray determination device determines whether or not the available discharge trays satisfy the third condition, and determines a discharge tray satisfying the third condition as a discharge tray for sample print output.

6. The image forming apparatus according to claim 5, wherein the print setting for the print process for a sample print output includes at least one of a size of a transfer member and a type of a transfer member.

7. The image forming apparatus according to claim 2, further comprising:

a user notification member configured to report that a sample print output is impossible when the discharge tray determination device fails to determine a discharge tray satisfying the condition.

8. The image forming apparatus according to claim 2, wherein the discharge tray determination device refers to specified discharge tray information about a specified discharge tray selected from the available discharge trays, and determines the specified discharge tray satisfying the condition as a discharge tray for sample print output.

9. The image forming apparatus according to claim 2, wherein the discharge tray determination device refers to discharge tray priority information about a priority order of the available discharge trays to search for a discharge tray having a highest priority satisfying the condition from the available discharge trays, and determines a retrieved discharge tray as a discharge tray for sample print output.

10. The image forming apparatus according to claim 2, further comprising:

a user interface configured to perform a setting for at least one of specified discharge tray information about a specified discharge tray selected from the available discharge trays and discharge tray priority information about a priority order of the available discharge trays.

11. The image forming apparatus according to claim 1, wherein the print controller is configured to manage a schedule of print job execution after the print controller divides a print job into print processes, and the print controller is configured to interrupt the schedule to perform a predetermined print process for a sample print output when a request is made to perform a print process for a sample print output of a predetermined sheet.

12. The image forming apparatus according to claim 1, wherein the print controller is configured to divide a print job processed for one file into a print process for one sheet.

13. The image forming apparatus according to claim 11, wherein the print controller is configured to manage a schedule of print job execution after the print controller divides a print job processed for one file into a print process for one sheet.

14. The image forming apparatus according to claim 1, wherein the image forming apparatus is connected to a network and the print controller is configured to divide a print job transmitted via the network into print processes.

15. An image forming system, comprising:

an image forming apparatus configured to print a sample image on a transfer member, the image forming apparatus including a discharge tray determination device configured to determine a discharge tray for sample print output from one of a plurality of available discharge trays specifiable by the image forming apparatus, a sample print output being dischargeable to the plurality of available discharge trays, and including a print controller configured to divide a print job into print processes and configured to control print output in response to a sample print output request, to cause a print process for a sample print output and for specifying a discharge tray determined by the discharge tray determination device to interrupt a print job; and a post-processing device configured to receive the transfer member bearing the sample image sent from the image forming apparatus, the post-processing device including a discharge tray configured to receive the transfer member bearing the sample image.

16. The image forming system according to claim 15, wherein the post-processing device includes at least one of a stacker and a finisher.

17. The image forming system according to claim 15, wherein the print controller is configured to divide a print job processed for one file into a print process for one sheet.

18. A non-transitory computer readable recording medium for storing a machine-executable program for operating an image forming apparatus to perform a sample print output, the machine-executable program comprising:

determining a discharge tray for sample print output from one of a plurality of available discharge trays specifiable by the image forming apparatus, the sample print output being dischargeable to the plurality of available discharge trays; and dividing a print job into print processes and controlling print output in response to a sample print output request, to cause a print process for a sample print output and for specifying a discharge tray to interrupt a print job.

19. The non-transitory computer readable recording medium for storing the machine-executable program for operating an image forming apparatus to perform a sample print output according to claim 18, wherein the dividing a print job into print processes includes dividing a print job processed for one file into a print process for one sheet.

* * * * *